US008983317B2

(12) United States Patent
Sakata

(10) Patent No.: US 8,983,317 B2
(45) Date of Patent: Mar. 17, 2015

(54) METHOD FOR DETECTING SURFACE POTENTIAL OF IMAGE BEARING MEMBER AND IMAGE FORMING APPARATUS

(71) Applicant: Canon Kabushiki Kaisha, Tokyo (JP)

(72) Inventor: Shiro Sakata, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 13/710,937

(22) Filed: Dec. 11, 2012

(65) Prior Publication Data

US 2013/0148991 A1 Jun. 13, 2013

(30) Foreign Application Priority Data

Dec. 13, 2011 (JP) ..... 2011-272760

(51) Int. Cl.
*G03G 15/02* (2006.01)
*G03G 13/22* (2006.01)

(52) U.S. Cl.
CPC ..... *G03G 13/22* (2013.01); *G03G 15/0266* (2013.01)
USPC ..... 399/48

(58) Field of Classification Search
CPC ..... G03G 15/0266; G03G 15/0283
USPC ..... 399/48, 50, 89
See application file for complete search history.

(56) References Cited

U.S. PATENT DOCUMENTS

| | | | | |
|---|---|---|---|---|
| 2008/0145075 | A1 | 6/2008 | Toda et al. | |
| 2009/0052921 | A1* | 2/2009 | Nishiwaki | 399/66 |
| 2010/0322652 | A1* | 12/2010 | Torimaru | 399/66 |
| 2011/0110677 | A1 | 5/2011 | Uehara | |
| 2011/0217064 | A1 | 9/2011 | Sakata | |

FOREIGN PATENT DOCUMENTS

| | | | |
|---|---|---|---|
| CN | 1525255 | A | 9/2004 |
| CN | 101354556 | A | 1/2009 |
| EP | 2267552 | A2 | 12/2010 |
| JP | 6-3932 | A | 1/1994 |
| JP | 2003-295540 | A | 10/2003 |

* cited by examiner

*Primary Examiner* — David Gray
*Assistant Examiner* — Gregory H Curran
(74) *Attorney, Agent, or Firm* — Canon USA Inc. IP Division

(57) ABSTRACT

An image forming apparatus configured to, in a state where a voltage is applied to a charging unit, determine a surface potential of an image bearing member using a first voltage applied when a current value obtained by, after applying a predetermined voltage to a transfer unit, detecting the current value while changing the applied voltage to a positive direction reaches a discharge current value, and a second voltage applied to the transfer unit when a current value obtained by, after applying the predetermined voltage to the transfer unit, detecting the current value while changing the applied voltage to a negative direction reaches the discharge current value.

14 Claims, 21 Drawing Sheets

METHOD FOR DETECTING SURFACE POTENTIAL OF IMAGE BEARING MEMBER AND IMAGE FORMING APPARATUS

BACKGROUND OF THE INVENTION

1. Field of the Invention

The present invention relates to an image forming apparatus that detects the surface potential of a photosensitive drum as an image bearing member and controls operations thereof based on a detection result.

2. Description of the Related Art

As an image forming apparatus that forms an image on a recording material, the configuration and general operation of an electrophotographic printer will be described with reference to FIG. 14. The printer illustrated in FIG. 14 includes a photosensitive drum 101 as an image bearing member, a semiconductor laser 102 as a light source, a rotational polygon mirror (also referred to as a polygonal mirror) 103 that is rotated by a scanner motor 104, and a laser beam 105 that is irradiated from the semiconductor laser 102 and scans the surface of the photosensitive drum 101.

A charging roller 106 acts as a charging member for uniformly charging the photosensitive drum 101. A development unit 107 is for developing an electrostatic latent image formed on the photosensitive drum 101 with toner. A transfer roller 108 acts as a transfer member for transferring a toner image developed on the photosensitive drum 101 by the development unit 107 onto a recording material. A fixing roller 109 acts as a fixing member that heats the toner image transferred onto the recording material to fuse the toner image on the recording material.

A feeding roller 110 acts as a feeding member that rotates to feed a recording material from a cassette in which the recording material is stacked onto a conveyance path. The cassette has a function of identifying the size of the recording material. A manual feeding roller 111 feeds a recording material from a manual feed port, which is a separate feed port to the cassette. Conveyance rollers 114 and 115 convey the fed recording material.

A recording material detection sensor 116 is for detecting a leading edge and a trailing edge of the fed recording material. A pre-transfer conveyance roller 117 feeds the conveyed recording material to a transfer unit configured of the photosensitive drum 101 and the transfer roller 108. A synchronization sensor 118 is for synchronizing the writing of the electrostatic latent image (image) on the photosensitive drum 101 and the recording material to be conveyed with the fed paper. Further, the synchronization sensor 118 also measures the length in the conveyance direction of the fed recording material. A discharge detection sensor 119 is for detecting the presence of a fixed recording material. A discharge roller 120 is for discharging a fixed recording material out of the apparatus.

A flapper 121 switches the conveyance destination (discharge out of the apparatus, or convey to a two-sided unit) of the recording material on which an image has been formed. A conveyance roller 122 is for conveying a recording material conveyed to a two-sided unit to a reversing unit. A reversal detection sensor 123 detects the leading edge and the trailing edge of the paper conveyed to the reversing unit. A reversing roller 124 reverses the recording material and conveys the recording material to a re-feeding unit by sequentially switching between forward direction rotation and reverse direction rotation.

A re-feeding sensor 125 detects the presence of a recording material at the re-feeding unit. A re-feeding roller 126 re-feeds the recording material at the re-feeding unit into a conveyance path for conveyance toward the transfer unit.

Next, a block diagram illustrating the configuration of a control circuit for controlling operations of the above-described printer will be described with reference to FIG. 15. In FIG. 15, a printer controller 201 rasterizes image data sent from a (not illustrated) external device, such as a host computer, into the bit data necessary for printing by the printer, reads information in the printer, and controls operations based on that information.

A printer engine control unit 202 controls operation of each unit in the printer engine based on instructions from the printer controller 201, and sends information in the printer engine to the printer controller 201. A paper conveyance control unit 203 drives and stops the motors (conveyance roller etc.) for feeding and conveying the recording material based on instructions from the printer engine control unit 202.

A high-voltage control unit 204 controls the output of high voltages in the various steps such as charging, development, and transfer in the electrophotographic process based on instructions from the printer engine control unit 202. An optical system control unit 205 controls the driving and stopping of the scanner motor 104, or the turning on of a laser beam based on instructions from the engine control unit 202.

A fixing device temperature regulation control unit 207 is for regulating the temperature of the fixing device to a temperature specified by the printer engine control unit 202. A two-sided unit control unit 208 controls operation of a two-sided unit that can be attached/detached from the printer main body. The two-sided unit control unit 208 performs a paper reversal operation and a re-feeding operation based on instructions from the printer engine control unit 202, and simultaneously notifies the printer engine control unit 202 of those operation states.

Next, a schematic configuration of a typical charging voltage application circuit will be described with reference to FIG. 16. This charging voltage application circuit is a high-voltage circuit for applying a high voltage to the charging roller 106. In FIG. 16, a circuit 401 generates a direct current (DC) voltage (also referred to as DC bias) applied to the charging roller. A voltage setting circuit unit 402 is a circuit whose setting value is changed when a pulse-width modulation (PWM) signal is received. The charging voltage application circuit illustrated in FIG. 16 also includes a transformer drive circuit unit 403 and a high-voltage transformer 404.

A feedback circuit unit 405 detects the value of the voltage applied to the charging roller 106 using a resistor R71, and transmits the detected voltage value to the voltage setting circuit unit as an analog value. Then, based on this analog value, a constant voltage is applied to the charging member.

Based on such a configuration, by performing a series of controls, a constant voltage can be applied to the charging roller acting as a charging member. Japanese Patent Application Laid-Open No. 6-3932 discusses such a technology, in which a constant voltage is applied to a charging roller.

The voltage at which discharge starts for the photosensitive drum acting as an image bearing member by applying a high voltage to the charging roller is known to change based on, for example, the temperature and humidity of the environment in which the printer is set, and the film thickness of the photosensitive drum.

The fact that the characteristics of the discharge start voltage to the photosensitive drum are different based on the environment (temperature and humidity) and the film thickness will now be described with reference FIG. 17. In FIG. 17, the horizontal axis represents the voltage applied to the photosensitive drum, and the vertical axis represents the current flowing to the photosensitive drum. The point at which the current starts to flow is the voltage at which discharge started. It can be seen from FIG. 17 that since the discharge voltage varies, the potential (Vd) of the photosensitive drum surface is not constant even if a constant voltage is applied to the photosensitive drum.

Further, since the sensitivity of the photosensitive drum surface to the laser beam also varies based on the environment (temperature and humidity) and the film thickness of the photosensitive drum (thickness: large (thick)>medium (standard)>small (thin)), the surface potential of the photosensitive drum also varies after laser irradiation even if a constant laser light amount is irradiated on the photosensitive drum.

FIG. 18 illustrates the fact that the potential (VL) of the photosensitive drum after irradiation by the laser beam exhibits different characteristics based on differences in the film thickness of the photosensitive drum. In FIG. 18, the horizontal axis represents the light amount of the laser beam, and the vertical axis represents the potential of the photosensitive drum after irradiation with the laser beam (expressed as VL). Based on this data, it can be seen that that the potential (VL) of the photosensitive drum after irradiation with the laser beam is not constant even if a constant laser light amount is irradiated on the photosensitive drum.

Further, as a photosensitive drum characteristic, fluctuation (also referred to as drum memory) in the surface potential of the photosensitive drum irradiated with light, such as by irradiation with a laser beam, also occurs. Normally, although the surface potential of the photosensitive drum is ideally 0 V after charge on the photosensitive drum surface has been removed, since the potential is negative due to the influence of this potential fluctuation, variation in the surface potential of the photosensitive drum after irradiation with the laser beam occurs.

Conventionally, to correct this variation, for example, a storage element (a non-volatile memory) has been provided in the cartridge as a replaceable part in the photosensitive drum for storing information indicating the sensitivity of the photosensitive drum, and application voltage values based on the usage amount of the photosensitive drum. Based on the information in the storage device, the high voltages (charging voltage and development voltage) are variably controlled to match the sensitivity and the usage amount.

Further, the light amount of the laser beam has been also variably controlled. However, the increases in conveyance speed and drive speed during printing and the increases in the capacity of the cartridges containing the toner made to improve the productivity of the printer have made it more difficult to sufficiently correct this variation with conventional technology that performs control based on information about the storage element.

The reason why it is difficult to correct this variation will be described referring to FIG. 19. In FIG. 19, if the potential after a photosensitive drum has been charged by a charging roller is Vd, the potential after exposure by a laser beam is VL, and the development potential when developing with a development unit is Vdc, the potential difference Vdc−VL during a normal period and the potential difference Vdc−VL when the sensitivity of the photosensitive drum has deteriorated are different. Since it is difficult to correct this potential difference, density unevenness occurs in the image.

SUMMARY OF THE INVENTION

The present invention is directed to an image forming apparatus capable of controlling the potential of a photosensitive drum appropriately to form an image that is free from density unevenness, regardless of changes in environment or differences in the film thickness of the photosensitive drum.

According to an aspect of the present invention, an image forming apparatus includes an image bearing member on which an image is formed, a charging unit configured to charge the image bearing member, a transfer unit configured to transfer the image formed on the image bearing member onto a transfer member, a voltage application unit configured to apply a voltage to the charging unit and the transfer unit, and a current detection unit configured to detect a current flowing to the image bearing member via the transfer unit when a voltage is applied to the transfer unit, wherein in a state where a voltage is applied to the charging unit, a surface potential of the image bearing member is determined using a first voltage applied from the voltage application unit when a current value obtained by, after applying a predetermined voltage to the transfer unit, detecting the current value with the current detection unit while changing the applied voltage to a positive direction, reaches a discharge current value, and a second voltage applied from the voltage application unit when a current value obtained by, after applying the predetermined voltage to the transfer unit, detecting the current value with the current detection unit while changing the applied voltage to a negative direction, reaches the discharge current value.

According to another aspect of the present invention, a method for detecting a surface potential of an image bearing member on which an image is formed, includes applying a voltage to a charging unit configured to charge the image bearing member, in a state where a voltage is applied to the transfer unit, applying a predetermined voltage to a transfer unit configured to transfer the image on the image bearing member onto a transfer member, and detecting a first current value flowing to the transfer member while changing the applied voltage to a positive direction, after applying the predetermined voltage to the transfer unit, detecting a second current value flowing to the transfer member while changing the applied voltage to a negative direction, and determining a surface potential of the image bearing member using a first voltage applied to the transfer unit when the detected first current value reaches a discharge current value and a second voltage applied from a voltage application unit when the detected second current value reaches the discharge current value.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The present exemplary embodiment is based on the assumption of a circuit configuration that includes a transfer voltage application circuit that applies a transfer voltage, which is a direct current (DC) voltage generated by a constant voltage power source, to a transfer roller acting as a transfer member in the above-described image forming apparatus, and a detection circuit for detecting the value of the current flowing to a photosensitive drum acting as a an image bearing member via a transfer roller during output of the DC voltage from the constant voltage power source.

Such a configuration enables the value of the current flowing to the photosensitive drum to be detected based on a simple circuit configuration using a transfer voltage application circuit, without having to provide a dedicated circuit for applying a DC voltage for current detection.

In the present exemplary embodiment, each discharge start voltage for the photosensitive drum is determined based on each current value detected by a current detection circuit when DC voltages with different negative values are respectively applied to a transfer roller during a period over which an image is not formed (non-image forming period). Further, the present exemplary embodiment is characterized by calculating the potential difference needed for the photosensitive drum to discharge and the surface potential of the photosensitive drum using the determination results.

Figure 1:
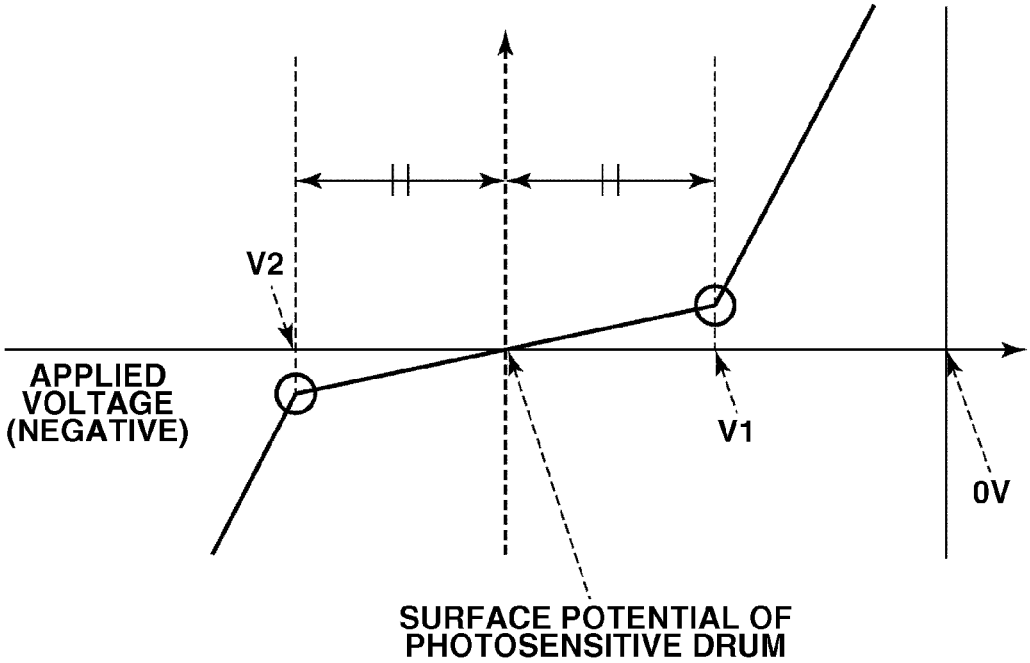
FIG. 1 illustrates a characteristic of a photosensitive drum.

FIG. 1 illustrates the symmetry of discharge start voltages, which forms the basis of the present exemplary embodiment. FIG. 1 illustrates that a discharge voltage V1, which is a negative first voltage, and a discharge voltage V2, which is a negative second voltage, are symmetrical.

As an example of a photosensitive drum discharge characteristic, as described above, the voltage value at which discharge starts changes based on the environment (temperature and humidity) and the film thickness of the photosensitive drum. However, even if the environment where the photosensitive drum is located or the film thickness is different, a characteristic of photosensitive drums is that the potential difference necessary for starting discharging with respect to a predetermined potential of the photosensitive drum is the same. This characteristic is similar to the discharge characteristic within a gap (between flat faces) when applying a high voltage.

Figure 2A:
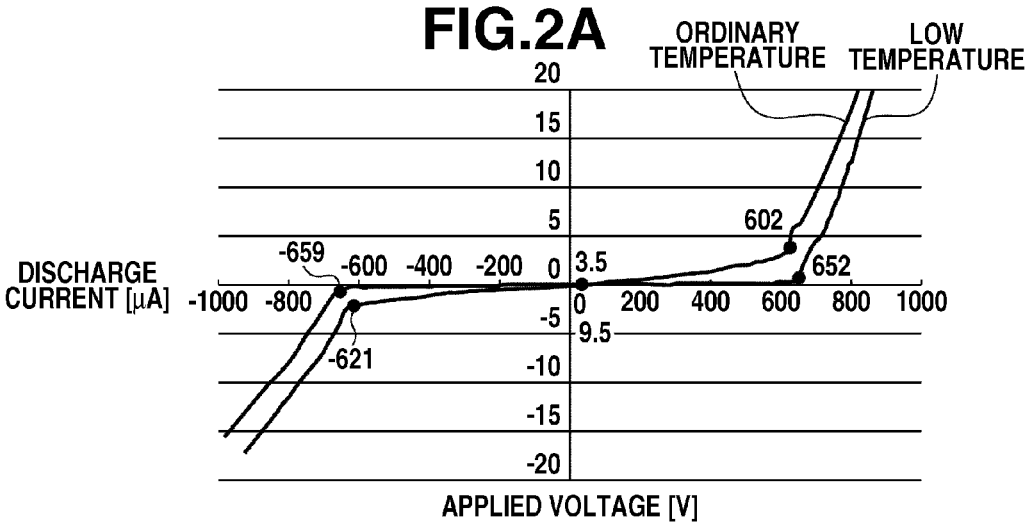
FIGS. 2A, 2B, and 2C are graphs illustrating measurement results of a photosensitive drum characteristic.
Figure 2B:
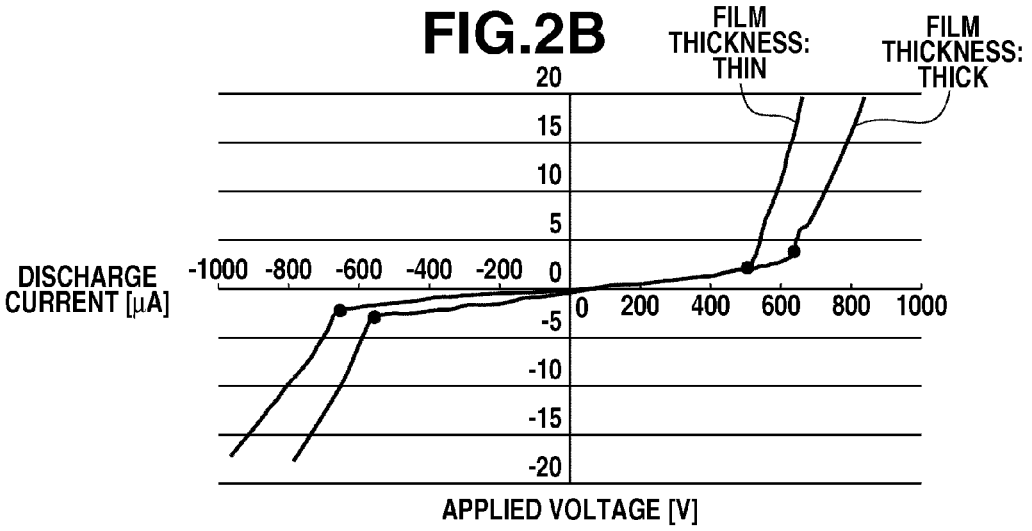
Figure 2C:
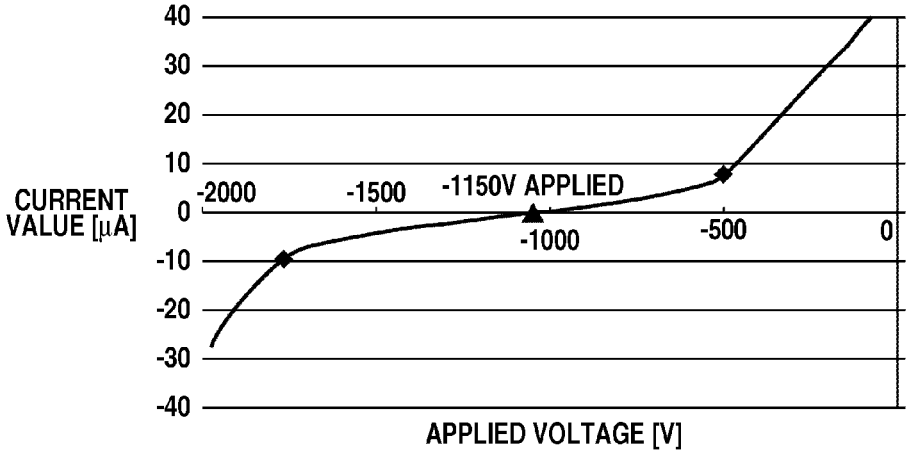

FIGS. 2A, 2B, and 2C illustrate measurement results of an actual photosensitive drum discharge characteristic. FIG. 2A illustrates the characteristic for an ordinary temperature and a low temperature, respectively, and FIG. 2B illustrates the characteristic for a case when the film thickness is thin and thick, respectively. The horizontal axis in the graph represents application voltage (V), and the vertical axis represents current (μA). The graph is drawn by plotting actual discharge voltages V1 and V2, and a center (V1+V2)/2 value.

In FIG. 2A, in an ordinary temperature environment, +602 V and −659 V are discharge voltages V1 and V2, respectively, with a middle of 3.5 V. In a low-temperature environment, +652 V and −621 V are discharge voltages V1 and V2, respectively, with a middle of 9.5 V.

Further, FIG. 2B illustrates that the discharge voltages when the film thickness of a photosensitive drum 201 is thin and when thick are symmetrical, with a middle of about 0 V.

Based on the above data, it can be confirmed that the discharge voltages V1 and V2 at each of which discharge starts are symmetrical with respect to the application voltage even if temperature varies or the film thickness changes. This data is for a case in which the potential of the photosensitive drum is roughly 0 V, and is a measurement result when both positive and negative DC voltages were applied.

This symmetry exhibits the same characteristic even when the potential of the photosensitive drum surface is not 0 V, for example, when the potential of the photosensitive drum surface is a negative value. An example of this is illustrated in FIG. 2C, which illustrates measurement data for a case in which the photosensitive drum surface has a negative potential. FIG. 2C shows that the discharge voltages V1 and V2 are symmetrical, with a middle of −1,150 V.

The present exemplary embodiment, focusing on this symmetry characteristic, is characterized by determining the potential difference necessary for the photosensitive drum to discharge and the surface potential of the photosensitive drum, and based on these detection results, setting the value of the voltage to be applied to the charging roller, and setting the light amount of the laser beam.

Figure 3:
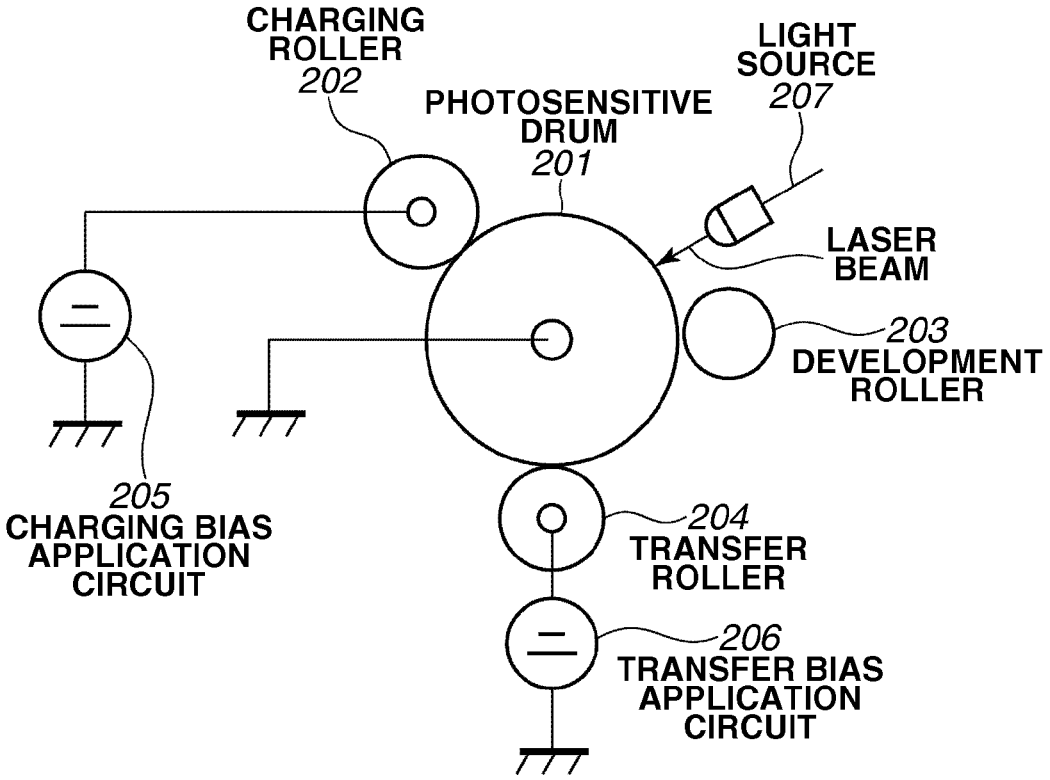
FIG. 3 is a schematic diagram of an image forming apparatus according to an exemplary embodiment of the present invention.

FIG. 3 is a schematic diagram illustrating members and high-voltage application circuits acting on the photosensitive drum according to the present exemplary embodiment. The image forming apparatus illustrated in FIG. 3 includes a photosensitive drum 201, a charging roller 202 acting as a charging member that charges the photosensitive drum 201, a development roller 203 as a development member that develops an electrostatic latent image formed on the photosensitive drum with toner, a transfer roller 204 as a transfer member that transfers a toner image developed on the photosensitive drum onto a recording material, a charging voltage application circuit 205 that applies a high voltage to the charging roller 202, a transfer voltage application circuit 206 that applies a DC voltage to the transfer roller 204, and a light source 207 as an exposure unit.

Once residual potential on the photosensitive drum 201 has been removed by applying an Alternating Current (AC) voltage to the charging roller 202 from the charging voltage application circuit, a voltage application operation by the transfer voltage application circuit 206 and an operation to detect the potential difference necessary for photosensitive drum discharge and the surface potential are started.

Figure 4:
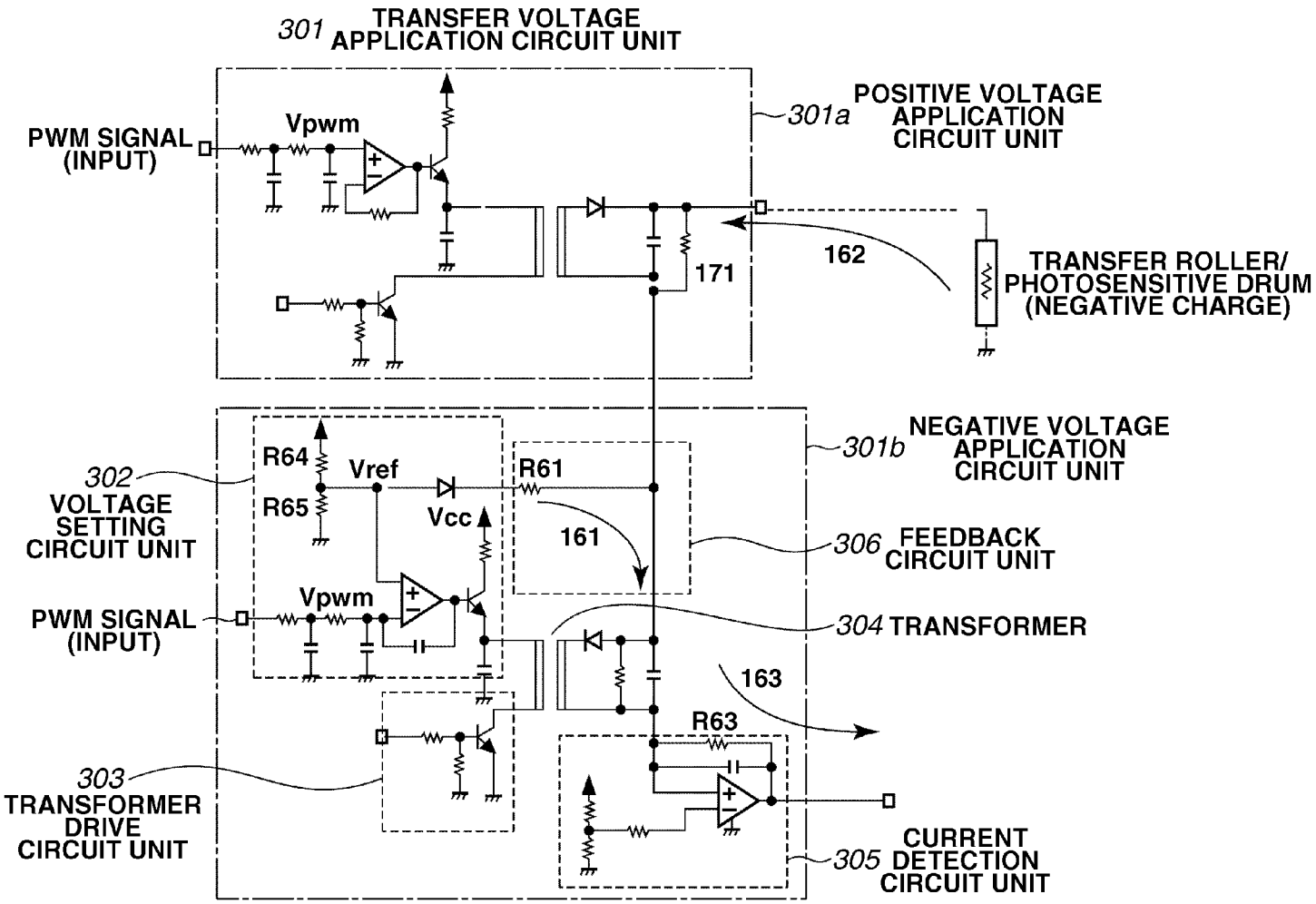
FIG. 4 illustrates a transfer voltage application circuit diagram according to a first exemplary embodiment.

FIG. 4 illustrates a schematic configuration of a transfer voltage application circuit 301 according to the present exemplary embodiment. Broadly speaking, this circuit includes two circuits, a positive voltage application circuit unit 301*a* that applies a positive polarity voltage to the transfer roller 204 (photosensitive drum 201), which has a negative charge, and a negative voltage application circuit unit 301*b* that applies a negative polarity voltage (negative voltage). In the present exemplary embodiment, since the operation is performed based on application of a negative voltage, a description of the circuit applying a positive voltage will be omitted.

In the negative voltage application circuit unit 301*b* illustrated in FIG. 4, a voltage setting circuit unit 302 can control the value of the output voltage based on an input PWM signal. The negative voltage application circuit unit 301*b* also includes a high-voltage transformer 304 and a drive circuit unit 303 for driving the high-voltage transformer 304.

A feedback circuit unit 306 is a circuit that detects a voltage output from the high-voltage transformer 304 via the resistor R61 in order to control a drive operation of the drive circuit unit 303 so that the voltage value is based on the PWM signal setting. A current detection circuit unit 305 is a circuit that detects with a resistor R63 a current value I63 obtained by adding a current value I62 flowing to the photosensitive drum acting as a carrier member and a current value I61 flowing from the feedback circuit unit 306, and transmits from a terminal J501 the detected current value I63 to the engine control unit 202 as an analog value.

Until discharge starts between the photosensitive drum 201 and the transfer roller 204, the section between the output device 210 and the transfer roller 204 is insulated. Consequently, until discharge is started, the current flowing to a detection resistor R63 is only the current I61 that is flowing from the feedback circuit unit 306. The current I61 is determined by the following formula based on the voltage value Vpwm set by the PWM signal, a reference voltage Vref, R64, and R65.

$$I61=(V\text{ref}-Vpwm)/R64-Vpwm/R65 \quad \text{(Formula 1)}$$

Further, the output voltage can also be determined by formula 2 by flowing the current value I61 through the resistor R61 in the feedback circuit unit 306.

$$V\text{out}=I61\times R61+Vpwm\square I61\times R61 \quad \text{(Formula 2)}$$

Figure 5:
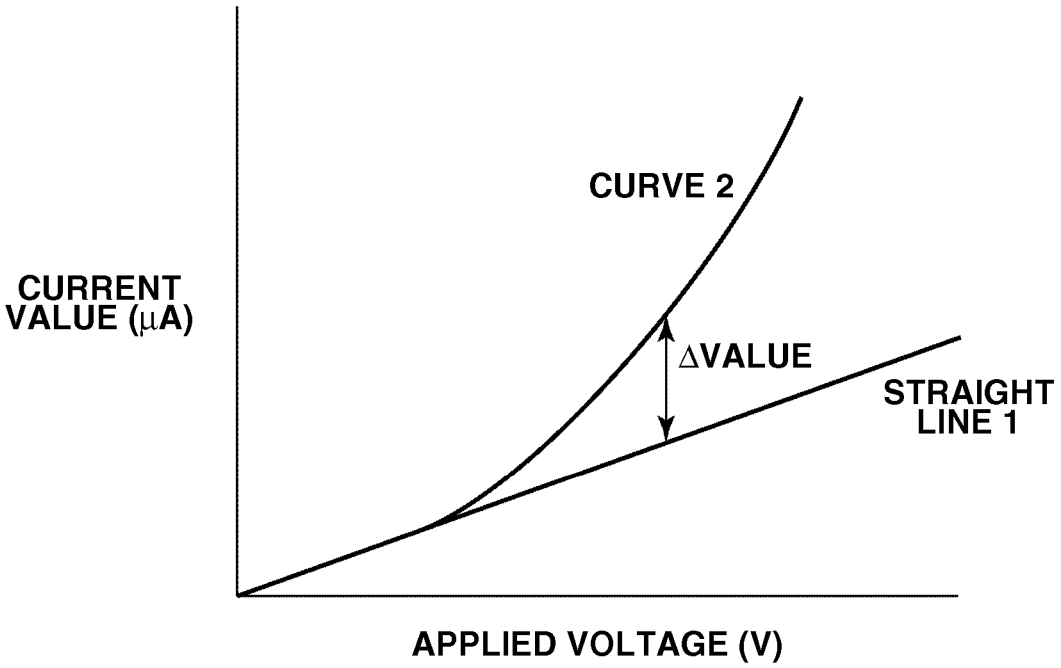
FIG. 5 is a graph illustrating a V-I characteristic during transfer voltage application.

FIG. 5 illustrates a relationship between the application voltage to the transfer roller 204 (photosensitive drum 201) as a negative charge and the value of the current flowing to the photosensitive drum 201. As illustrated by the straight line 1 in FIG. 5, until discharge is started, because the only current flowing to the resistor R63 in the current detection circuit unit 305 is the I61 based on the PWM signal, the relationship between the application voltage and the current is a straight line.

However, when discharge between the photosensitive drum 201 and the transfer roller 204 starts, the current value I62 flowing to the photosensitive drum 201 flows via a resistor R71 in the circuit to which a positive voltage is applied.

Thus, the current flowing here is I63, which is obtained by adding the current value I62 and the current value I61 flowing from the feedback circuit unit 306. Specifically, as illustrated in FIG. 5, the relationship between the application voltage and the current is represented by curve 2 that has a branch point at the point where discharge starts.

Therefore, the current flowing between the photosensitive drum 201 and the transfer roller 204 can be calculated based on a Δ value obtained by subtracting the value of straight line 1 from curve 2. The point at which the Δ value is the desired current value (target discharge current value) I is determined as the voltage at which discharge has started.

The desired current value (target discharge current value) I needs to be set based on a resistance value of the transfer roller 204. Although slight, a dark current flows through the transfer roller 204 until discharge is started.

Figure 6:
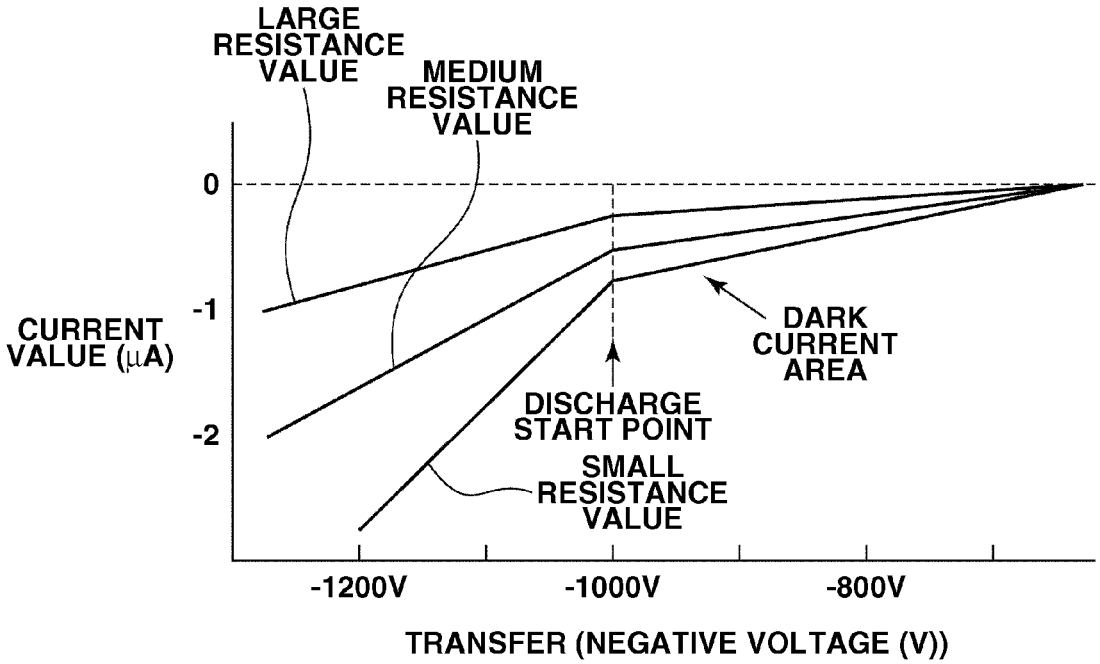
FIG. 6 is a graph illustrating a current characteristic during transfer negative bias application.

This dark current is determined based on the resistance value of the transfer roller 204. FIG. 6 illustrates the difference in the flowing current value based on the difference in the resistance value of the transfer roller 204. As illustrated in FIG. 6, the value of the dark current is different based on the difference in the resistance value of the transfer roller 204. This difference can be understood as having an effect on the current detection accuracy.

The resistance value of the transfer roller 204 can be determined based on a difference calculated by applying a pre-set constant voltage and detecting the flowing current value at that point from the relationship illustrated in FIG. 6. In FIG. 6, for example, the resistance value can be determined based on the current value detected when a voltage of −1,200 V is applied.

If the resistance value can be determined, a correction current value at the point where discharge started can be obtained based on the resistance value. The desired current value I (target discharge current value) is set in consideration of this correction current value. Correction current values according to the resistance value are stored as a table in a non-volatile memory in the image forming apparatus control unit. However, these values may also be calculated using a calculation formula rather than a table.

After the potential of the photosensitive drum 201 is charged to a predetermined minus potential (negative potential) by applying to the charging roller 202 a predetermined voltage composed of a DC voltage and an alternating current (AC) voltage, different voltages are applied from the transfer voltage application circuit by either changing the voltage in the positive direction (decreasing the absolute value of the voltage) or changing the voltage in the negative direction (increasing the absolute value of the voltage) with respect to that minus potential.

Two discharge start voltages are detected, the discharge start voltage V1 having a small absolute value and the discharge start voltage V2 having a large absolute value. One-half of the difference in the absolute values of the discharge start voltages V1 and V2 is set as the voltage difference ΔV necessary for the photosensitive drum 201 to start discharge (refer to FIG. 1).

Further, after the laser beam is irradiated from the light source 207 on the photosensitive drum 201, a voltage with the greater absolute value is again applied from the transfer voltage application circuit. The discharge start voltage obtained based on the current detected at that point is set as V3. The potential VL of the photosensitive drum after irradiation with a laser beam from the light source 207 can be calculated using this discharge start voltage V3 and the voltage value ΔV obtained as described above. In addition, the light amount value of the irradiated laser beam is set (corrected) so as to match the calculated value of the potential VL.

By controlling in this manner, the potential (after laser beam irradiation) VL of the photosensitive drum–development voltage Vdc can be stabilized even if there are changes in the environment (temperature and humidity) or differences in the film thickness of the photosensitive drum.

Figure 7:
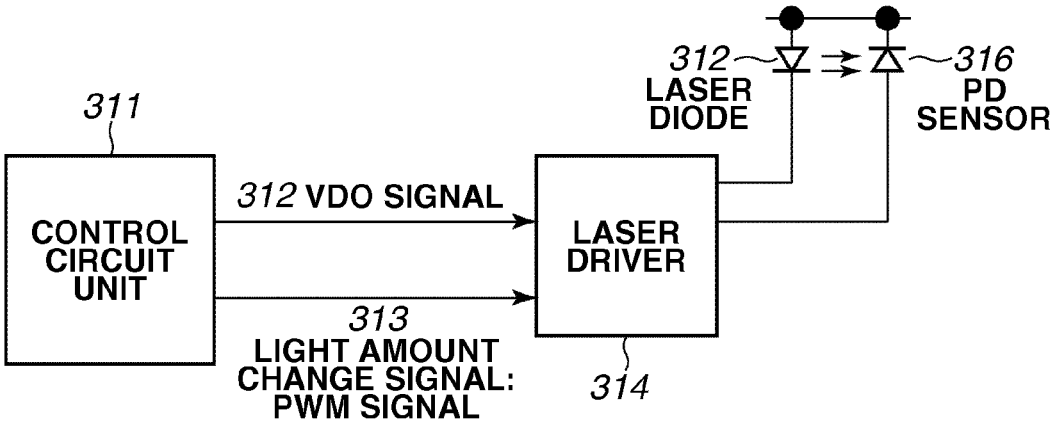
FIG. 7 is a laser drive circuit configuration diagram according to the first exemplary embodiment.

FIG. 7 illustrates a schematic configuration of a laser drive circuit according to the present exemplary embodiment. In FIG. 7, while monitoring the amount of light emitted from the laser diode with a PD sensor 316, a laser driver 314 performs control so that the light amount is constant.

A light amount change signal (also referred to as a PWM signal) 313 is input between a control circuit unit 311 and the laser driver 314, which enables the amount of light emitted from the laser beam to be varied based on this light amount change signal (PWM signal).

In this configuration, since the laser beam light amount that is irradiated on the photosensitive drum 201 can be controlled, after the potential of the photosensitive drum after laser irradiation (VL) is detected, if that value is different from the desired value, the VL value can be corrected by varying the laser beam light amount. By performing such a correction, the drum potential (after laser beam irradiation)–development voltage (Vdc) can be obtained.

Next, the controls performed in the present exemplary embodiment will be described with reference to the flowchart of FIG. 8, the timing chart of FIG. 9, and the potential diagrams of FIGS. 10A, 10B, 10C, and 10D. The operations performed in the flowchart of FIG. 8 are controlled by the engine control unit 202 (refer to FIG. 14).

Figure 8:
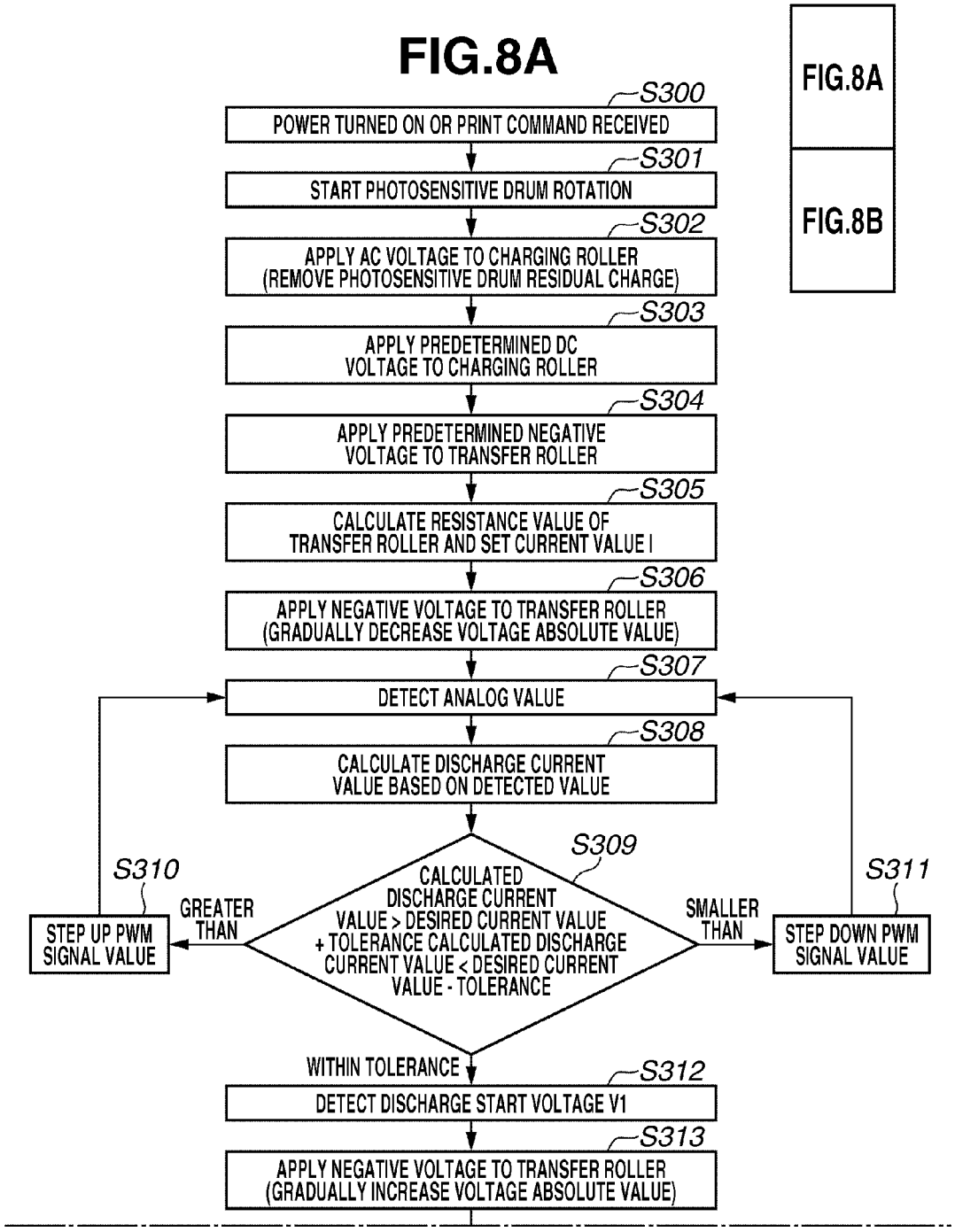
FIG. 8 (8A and 8B) is a flowchart according to the first exemplary embodiment.
Figure 8B:
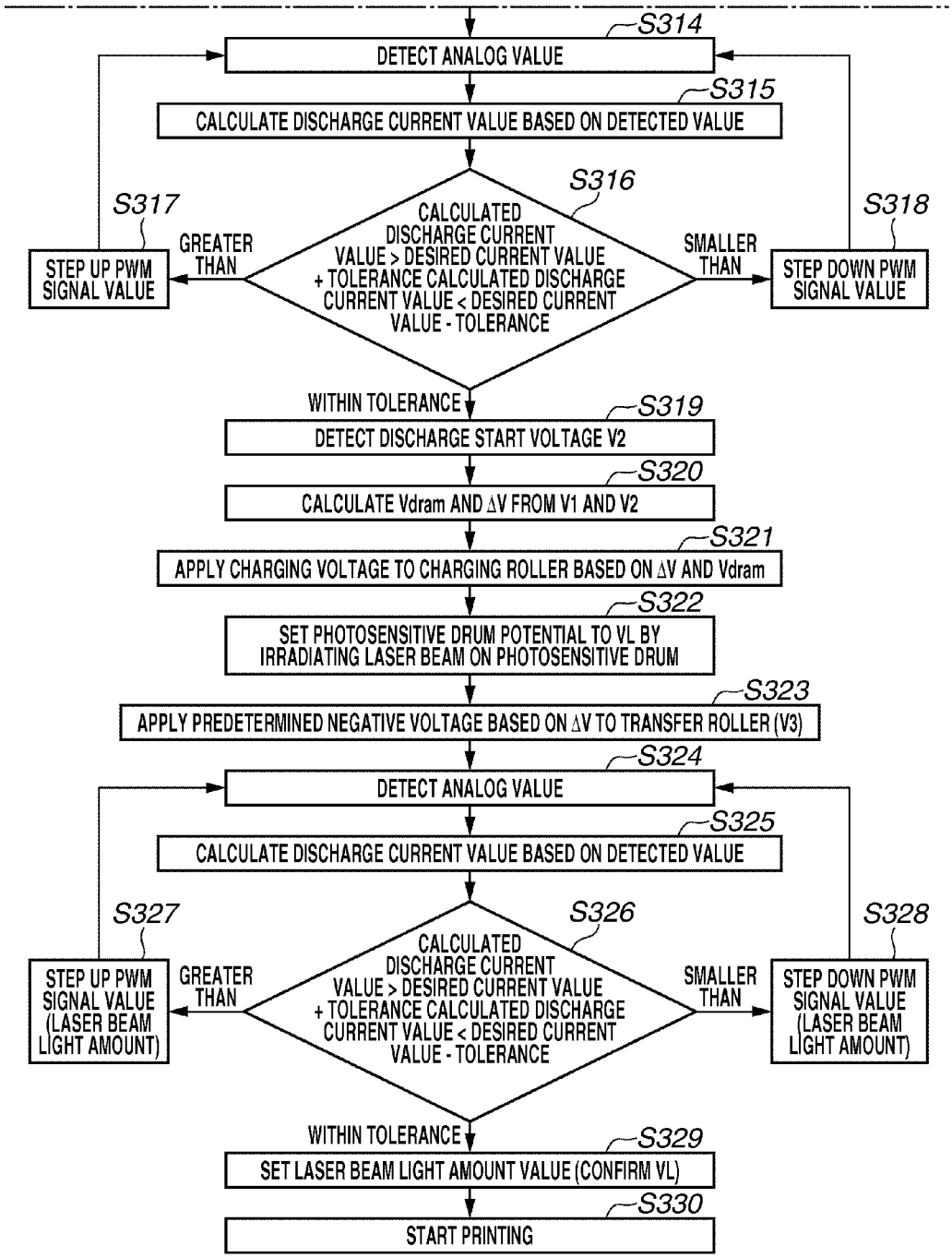

In FIG. 8, first, in step S300, the power of the image forming apparatus is turned on or a print command is received. Then, in step S301, pre-rotation (after the power is turned on) or pre-rotation (after a print command is received), which are an initialization operation, is executed. In step S302, during the period that the photosensitive drum 201, which is an image bearing member, is rotating (non-image period during which an image is not formed on the photosensitive drum), residual charge on the photosensitive drum 201 is removed by applying an AC voltage to the charging roller 202.

Figure 16:
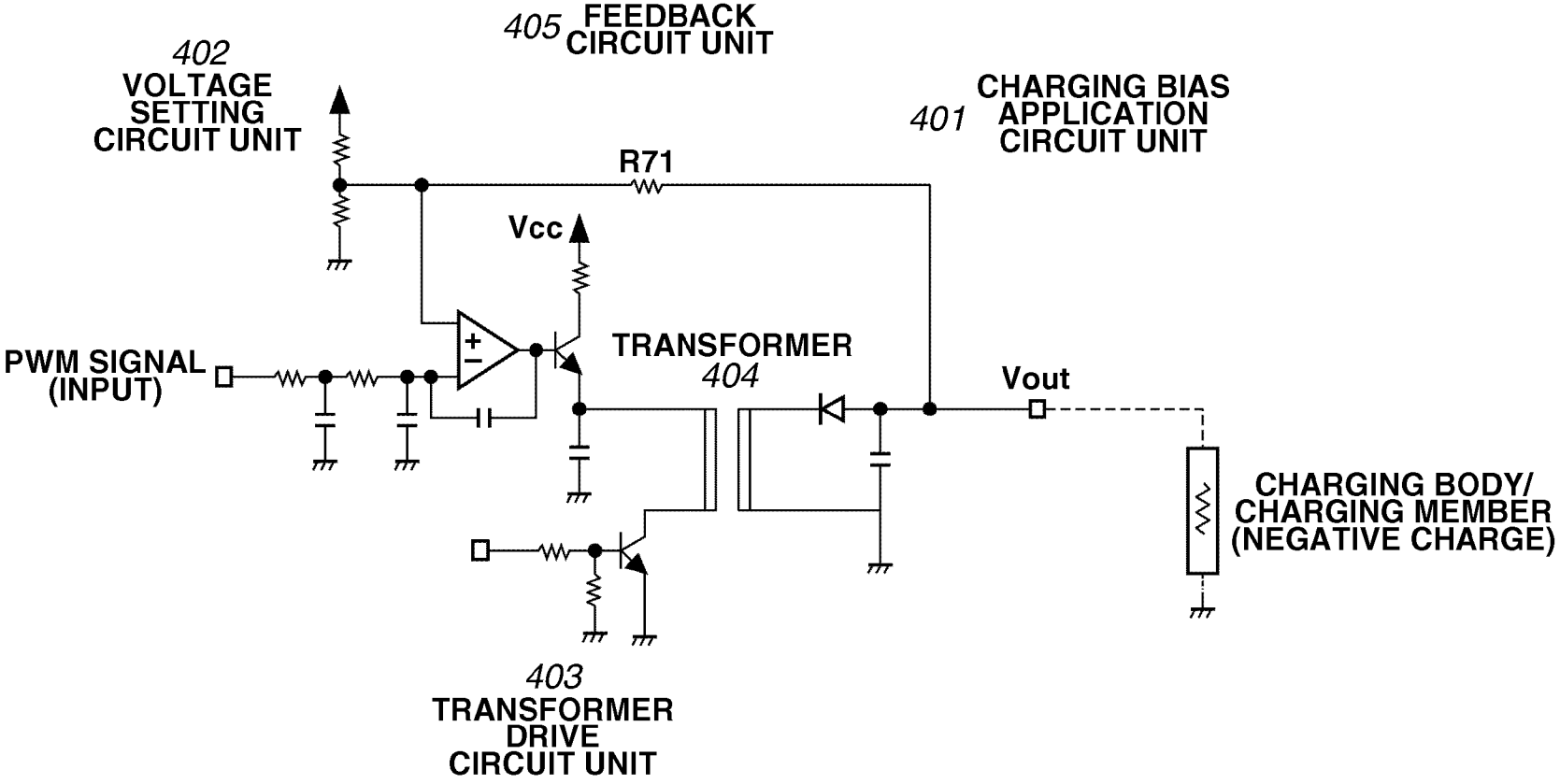
FIG. 16 illustrates a conventional charging voltage application circuit.
Figure 17:
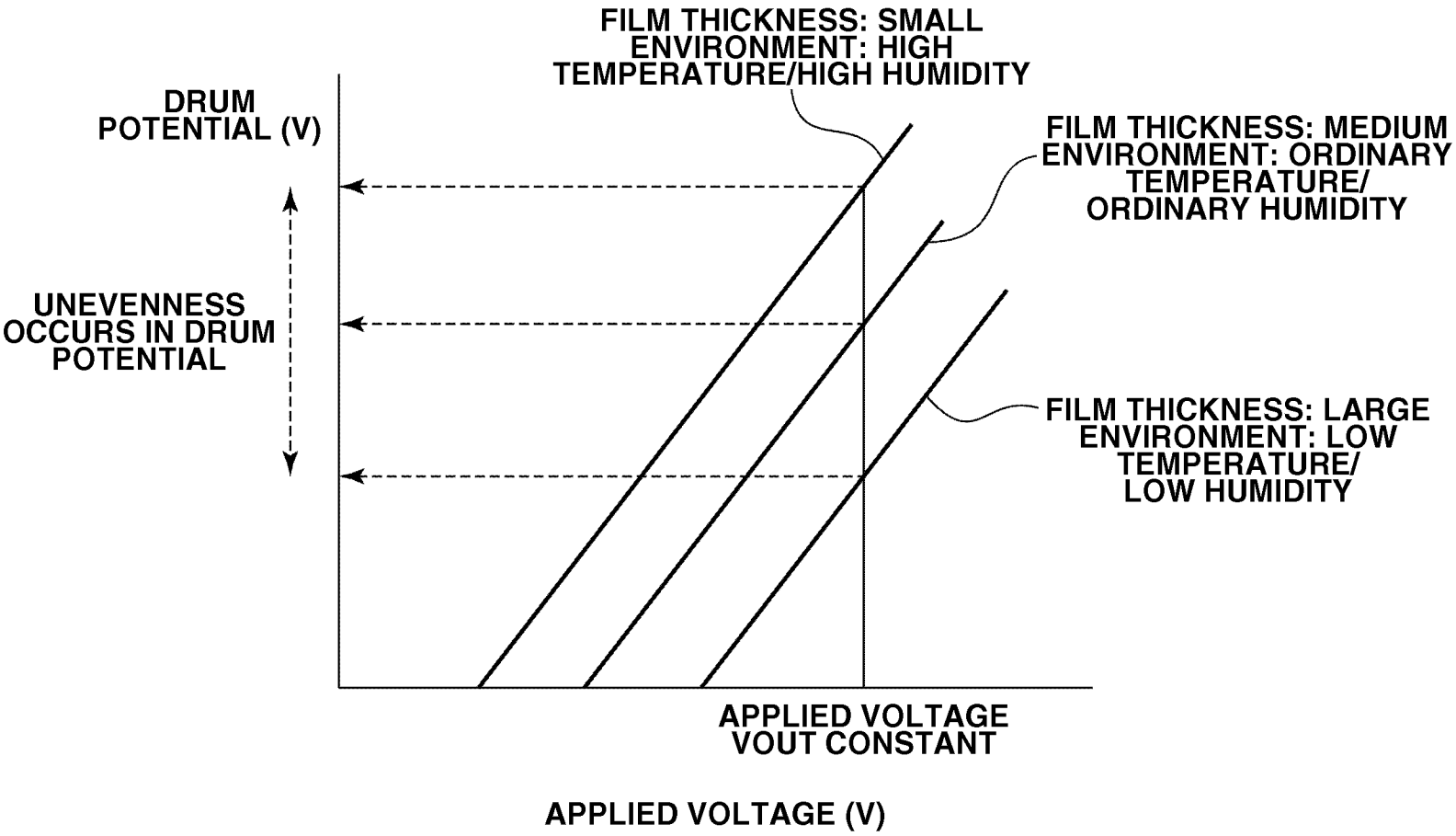
FIG. 17 is a graph illustrating that variation is produced in the potential Vd of a photosensitive drum.
Figure 18:
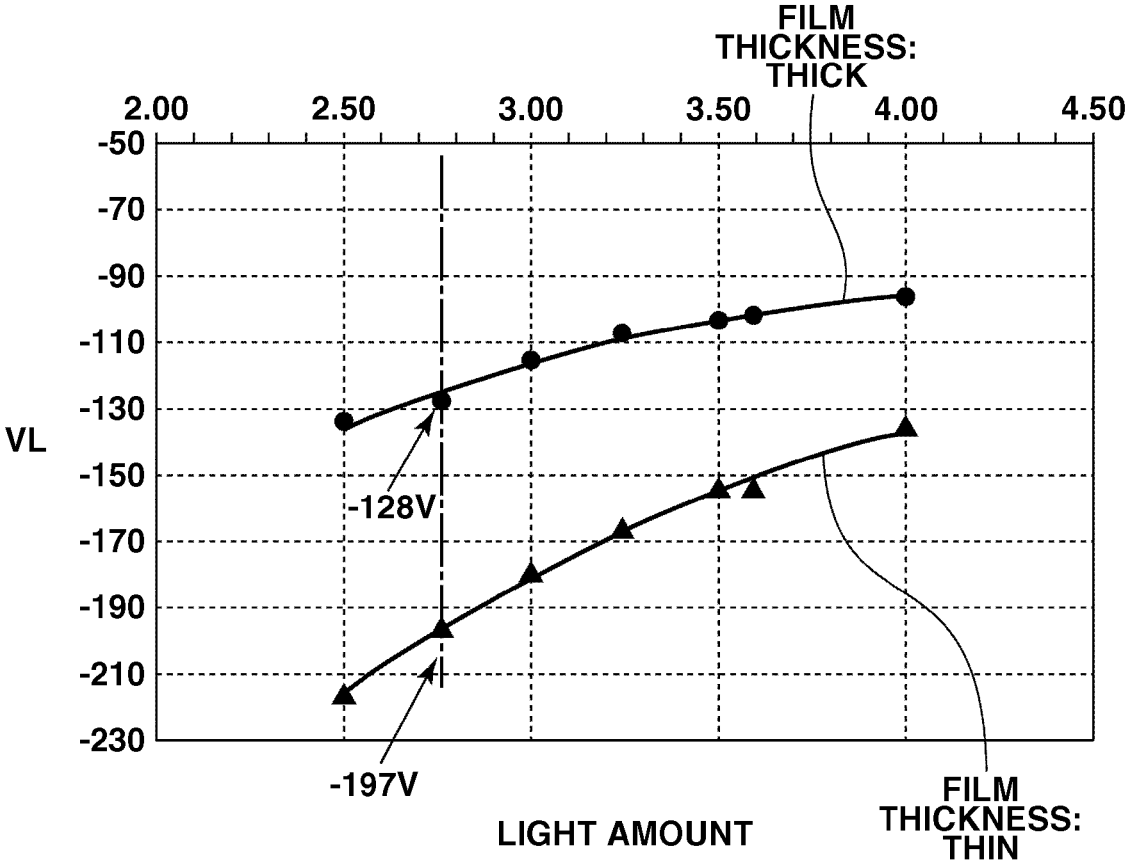
FIG. 18 is a graph illustrating that variation is produced in the potential VL of a photosensitive drum after laser irradiation.
Figure 19:
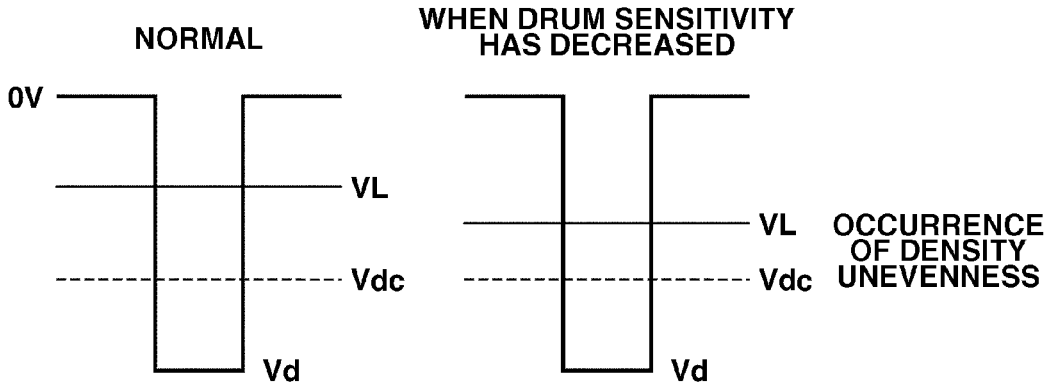
FIG. 19 illustrates that variation is produced in the surface potential of a photosensitive drum.

Then, in step S303, the photosensitive drum 201 is charged to a negative potential by applying a desired AC voltage to the charging roller 202 using a charging voltage application circuit (refer to FIG. 16). In step S304, a predetermined voltage (negative voltage) is applied to the transfer roller 204. In step S305, the desired current value I is determined as described above by calculating the voltage value applied at that point and the resistance value of the transfer roller based on the detected current value.

In step S306, a negative voltage is applied to the transfer roller with respect to the charging voltage value when the photosensitive drum 201 was charged by applying the desired AC voltage. First, the absolute value of the negative voltage gradually decreases. Then, in step S307, the current I63 obtained by adding the current I62 flowing from the transfer roller 204 and the current I61 flowing from the feedback circuit is detected as an analog value input from the terminal J501.

In step S308, based on that detection value, the discharge current is calculated based on the method described above. Then, in step S309, the calculated discharge current value and the desired current value (target discharge current value) I are compared to determine whether that current value I is within a tolerance.

Specifically, if the calculated discharge current value is greater than the desired current value I+tolerance ("GREATER THAN" in step S309), it is determined that the discharge start voltage is set to a lower voltage, so the processing proceeds to step S310. In step S310, the voltage value is increased by taking the PWM signal value up a step.

However, if the calculated discharge current value is smaller than the desired current value I–tolerance ("LESS THAN" in step S309), it is determined that the discharge start voltage is set to a higher voltage, so that the processing proceeds to step S311. In step S311, the voltage value is decreased by taking the PWM signal value down a step.

If the PWM signal has been controlled so that the calculated discharge current value and the desired current value are within the tolerance, then in step S312, the voltage value at that point is set as the discharge start voltage V1 for the side with the low absolute value.

Then, once again, in step S313, a negative voltage is applied to the transfer roller 204 with respect to the charging voltage value when the photosensitive drum 201 was charged by applying the desired AC voltage. However, this time the absolute value of the negative voltage gradually increases. Then, in step S314, the current I63 obtained by adding the current I62 flowing from the transfer roller 204 and the current I61 flowing from the feedback circuit is detected as an analog value input from the terminal J501. In step S315, based on that detection value, the discharge current is calculated based on the method described above.

Then, in step S316, the calculated discharge current value and the desired current value I are compared to determine whether the desired current value I is within a tolerance. Specifically, if the calculated discharge current value is greater than the desired current value I+tolerance ("GREATER THAN" in step S316), it is determined that the discharge start voltage is set to a lower voltage, so that the processing proceeds to step S317. In step S317, the voltage value is increased by taking the PWM signal value up a step.

However, if the calculated discharge current value is smaller than the desired current value I–tolerance ("LESS THAN" in step S316), it is determined that the discharge start voltage is set to a higher voltage, so that the processing proceeds to step S318. In step S318, the voltage value is decreased by taking the PWM signal value down a step.

If the PWM signal has been controlled so that the calculated discharge current value and the desired current value are within the tolerance, then in step S319, the voltage value at that point (PWM signal value B) is set as the discharge start voltage V2 for the side with the high absolute value. Then, in step S320, ½ of the difference in the absolute values of the discharge start voltages V1 and V2 is calculated, and based on the calculated value, the voltage difference ΔV necessary for the photosensitive drum 201 to start discharge and the surface potential Vdram of the photosensitive drum 201 are calculated.

Next, the processing proceeds to a sequence for detecting the potential VL of after the photosensitive drum 201 is irradiated with a laser beam. In step S321, the photosensitive drum 201 is charged by applying to the charging roller 202 a charging voltage based on the potential difference ΔV and the surface potential Vdram. Then, in step S322, the surface of the photosensitive drum 201 is set to a potential VL state by irradiating the laser beam on the photosensitive drum 201.

Next, in step S323, a predetermined negative voltage based on the voltage difference ΔV is applied to the transfer roller 204. Then, in that state, in step S324, the current I63 obtained by adding the current I62 flowing from the transfer roller 204 and the current I61 flowing from the feedback circuit is detected as an analog value input from the terminal J501.

In step S325, based on that detection value, the discharge start current value is calculated based on the method described above. Then, in step S326, the calculated discharge current value and the desired current value I are compared to determine whether the current value I is within a tolerance. In step S327, if the calculated discharge current value is greater than the desired current value I+tolerance ("GREATER THAN" in step S326), it is determined that the potential VL of the photosensitive drum 201 surface is set low, so that the processing proceeds to step S327. In step S327, the laser beam light amount is decreased by taking the laser light amount setting value down a step.

However, if the calculated discharge current value is less than the desired current value I−tolerance ("LESS THAN" in step S326), it is determined that the potential VL of the photosensitive drum 201 surface is set high, so that the processing proceeds to step S328. In step S328, the laser beam light amount is increased by taking the laser light amount setting value up a step. If the current value I is within the tolerance based on the above-described control ("within tolerance" in step S326), then in step S329, the setting value of the laser beam light amount at that point is confirmed as the desired laser beam light amount.

By executing the above-described sequence, the VL−Vdc potential difference is controlled to a predetermined value. In step S330, after these settings have been completed, the image forming operation is started.

Next, the voltage application to the charging roller, the voltage application to the transfer roller, the timing of laser beam irradiation from the light source, and the state of the corresponding photosensitive drum potential at each step of the control described in FIG. 8 will be described with reference to FIG. 9 and FIGS. 10A, 10B, 10C, and 10D.

Figure 9:
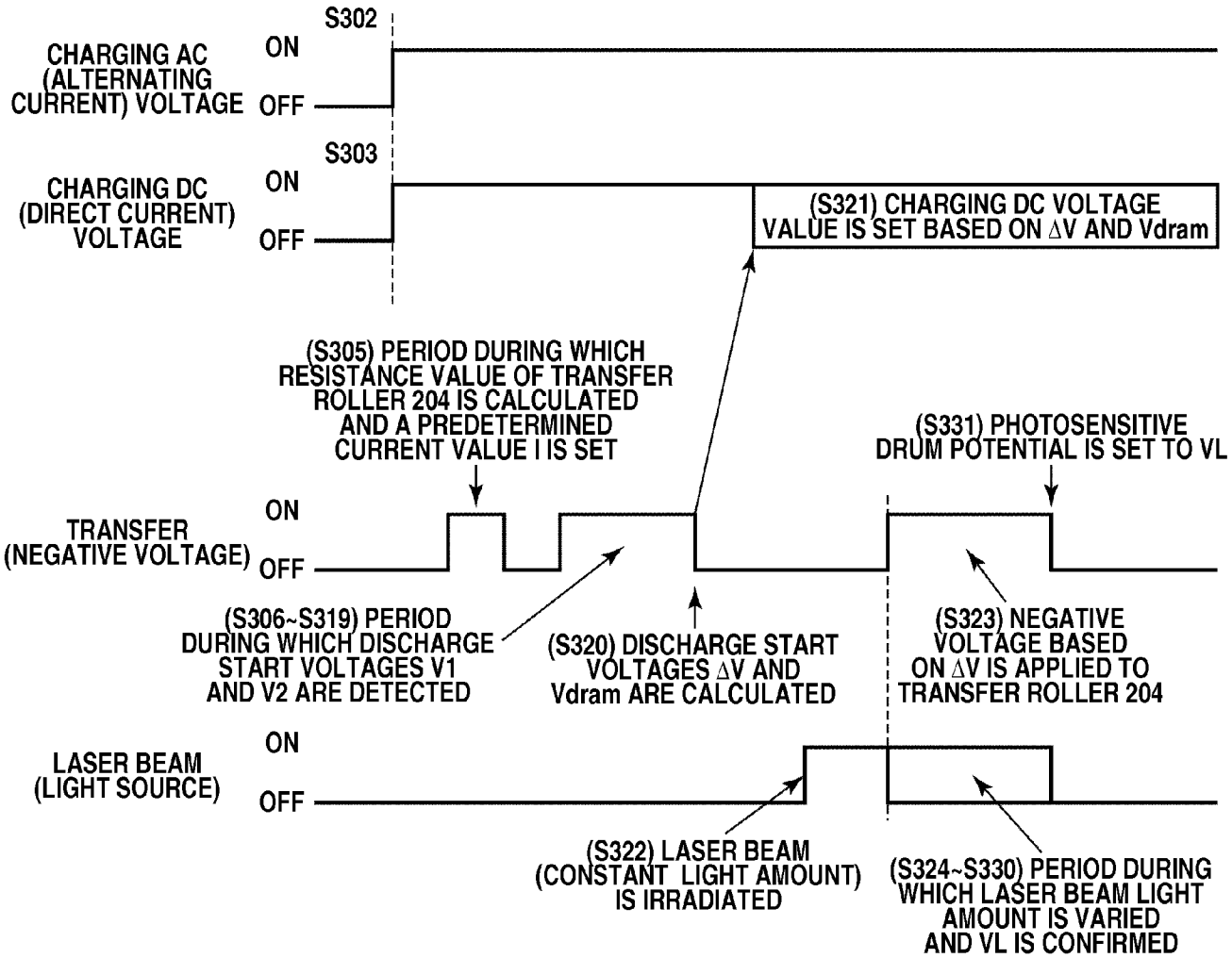
FIG. 9 is a timing chart according to the first exemplary embodiment.

In FIG. 9, an AC voltage and a DC voltage (a voltage in which an AC voltage and a DC voltage are superimposed) are applied to the charging roller at a timing corresponding to steps S302 and S303 in FIG. 8. Then, the resistance value of the transfer roller is calculated by applying a negative voltage to the transfer roller 204 at a timing corresponding to steps S302 and S303 in FIG. 8, and the desired current value I is set.

Then, at a timing corresponding to steps S306 to S319, the discharge start voltages V1 and V2 are detected, and at a timing corresponding to step S320, the drum surface potential Vdram and the potential difference ΔV are calculated. Next, while applying current and voltage to the charging roller based on ΔV and Vdram at a timing corresponding to step S321, the laser beam is irradiated on the photosensitive drum at a timing corresponding to step S322.

At a timing corresponding to steps S323 to 326, the photosensitive drum surface potential VL is detected, and at a timing corresponding to steps S327 to 331, the photosensitive drum potential is controlled to VL by varying the light amount of the laser beam.

Figure 10A:
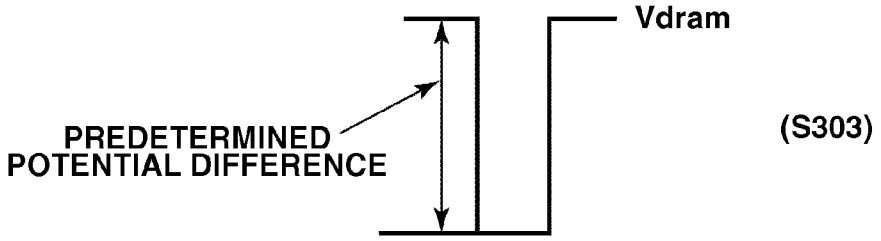
FIGS. 10A, 10B, 10C, and 10D illustrate changes in the potential of a photosensitive drum according to the first exemplary embodiment.
Figure 10B:
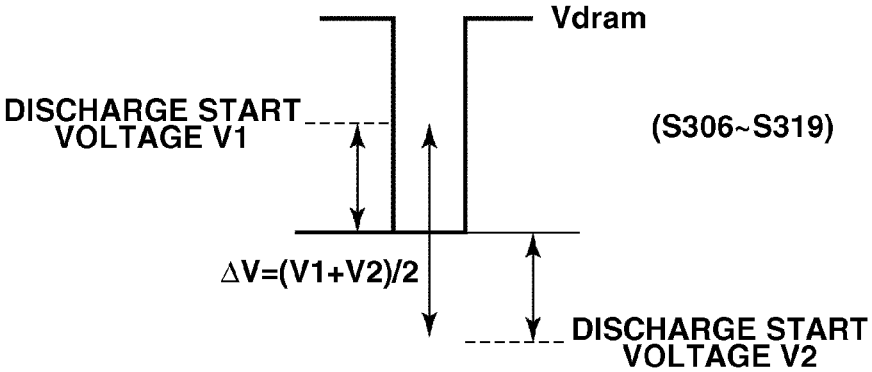

FIGS. 10A, 10B, 10C, and 10D each illustrate a state of the photosensitive drum surface potential at the respective steps. FIG. 10A illustrates a state of the photosensitive drum surface potential at a timing corresponding to step S303 of FIG. 8. FIG. 10B illustrates a state of the photosensitive drum surface potential at a timing corresponding to steps S306 to S319 of FIG. 8.

Figure 10C:
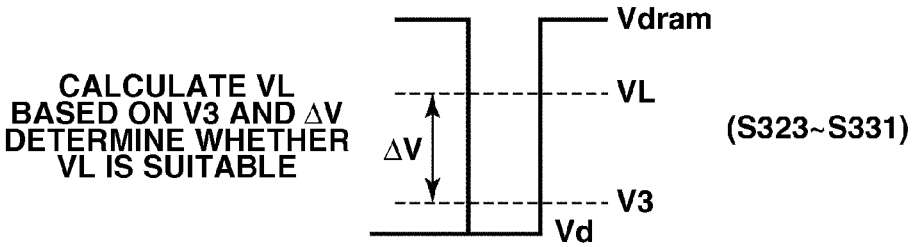
Figure 10D:
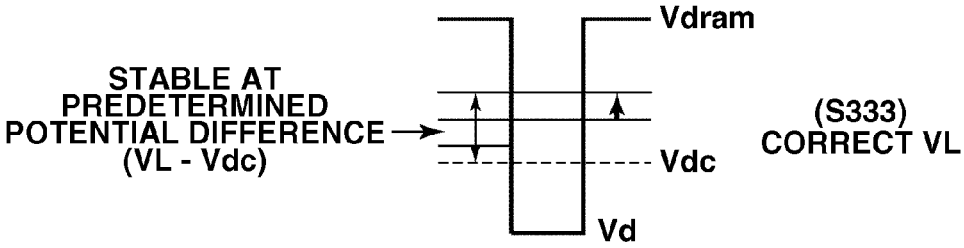

FIG. 10C illustrates a state of the photosensitive drum surface potential at a timing corresponding to steps S320 to S323 of FIG. 8. FIG. 10D illustrates a state of the photosensitive drum surface potential at a timing corresponding to step S329 of FIG. 8. Based on the above control, the potential difference between VL (exposure potential) and Vdc (development voltage) can be stabilized at a desired potential difference.

Thus, according to the present exemplary embodiment, a high-quality image with less density unevenness can be formed by appropriately controlling the potential of a photosensitive drum, regardless of changes in environment or differences in the film thickness of the photosensitive drum.

A second exemplary embodiment will now be described. The present exemplary embodiment is based on an assumption of the same configuration as the first exemplary embodiment. The difference with the first exemplary embodiment is that in the second exemplary embodiment, the potential difference necessary for the photosensitive drum to discharge and the surface potential of the photosensitive drum are detected, and based on those detection results, the voltage applied to the development roller is set.

The configuration in the present exemplary embodiment does not include a function of varying the laser beam light amount like in the first exemplary embodiment. Since a function of varying the laser beam light amount is not included, the configuration is cheaper. Further, since the configuration and the operations for detecting the potential difference and the surface potential are the same as in the first exemplary embodiment, a description thereof will be omitted here.

Next, the controls performed in the present exemplary embodiment will be described with reference to the flowchart of FIG. 11 (11A and 11B), the timing chart of FIG. 12, and the potential diagrams of FIGS. 13A, 13B, 13C, and 13D.

Figure 11:
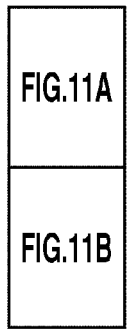
FIG. 11 (11A and 11B) is a flowchart according to a second exemplary embodiment.
Figure 11A:
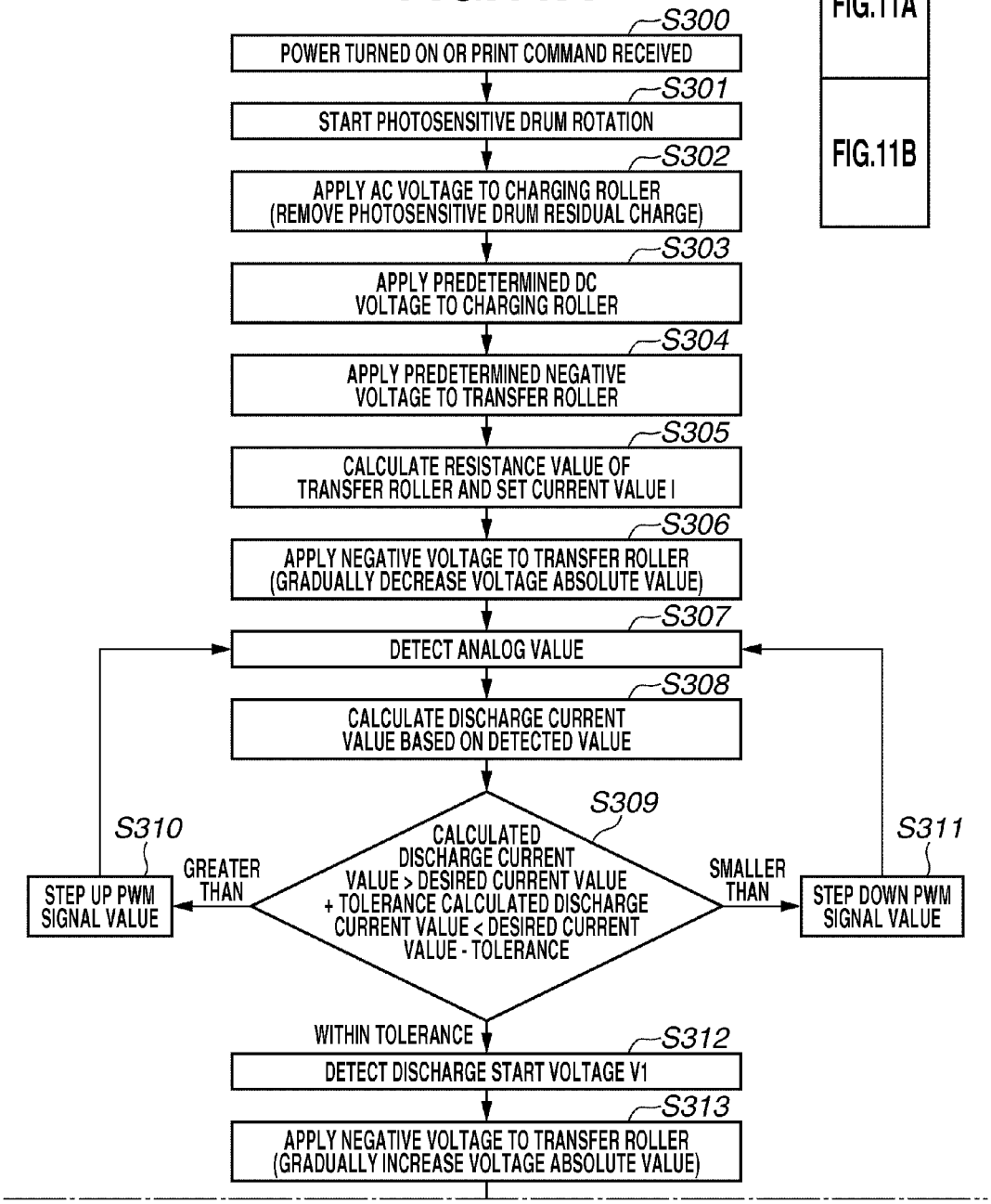
Figure 11B:
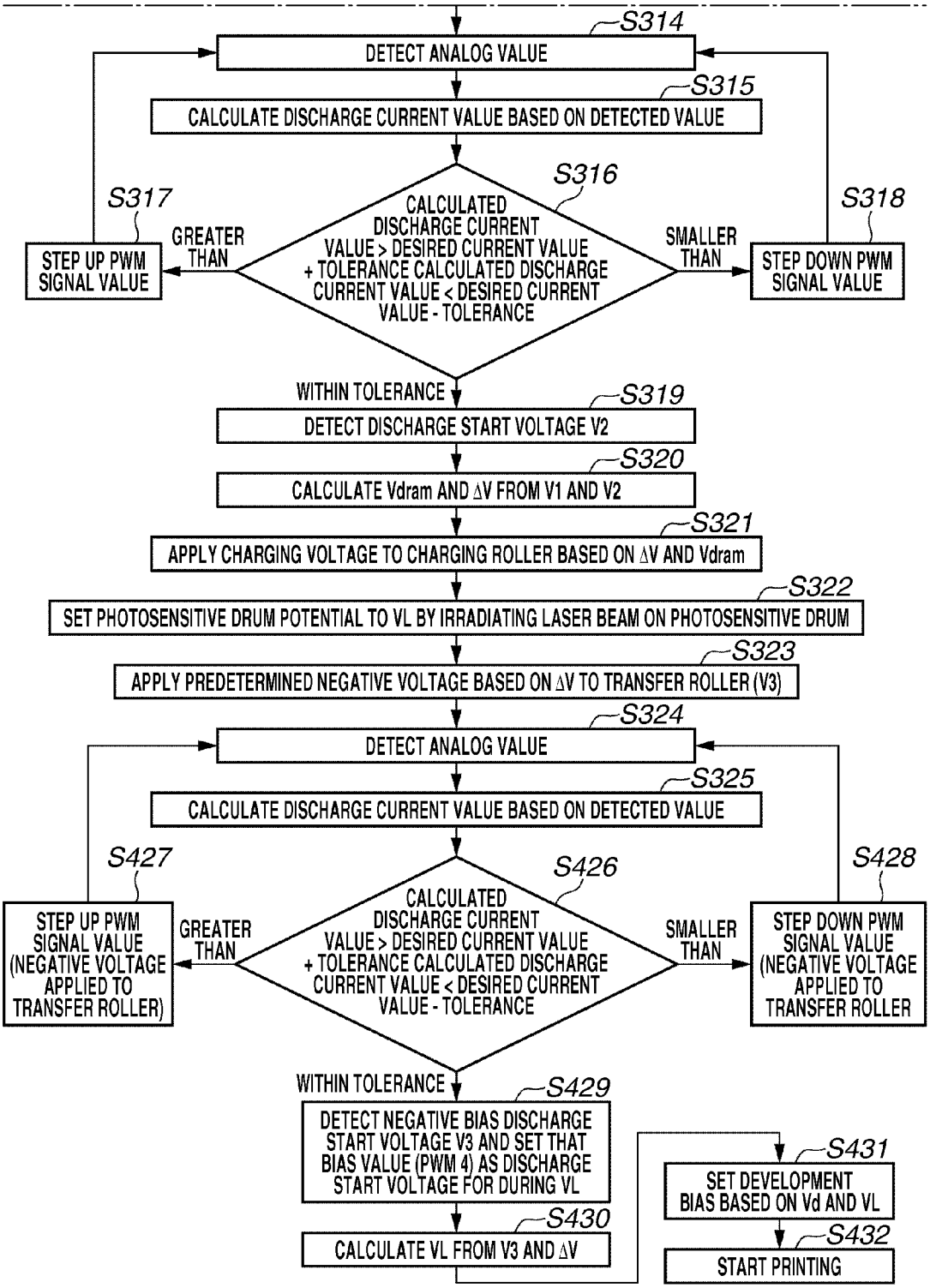
Figure 14:
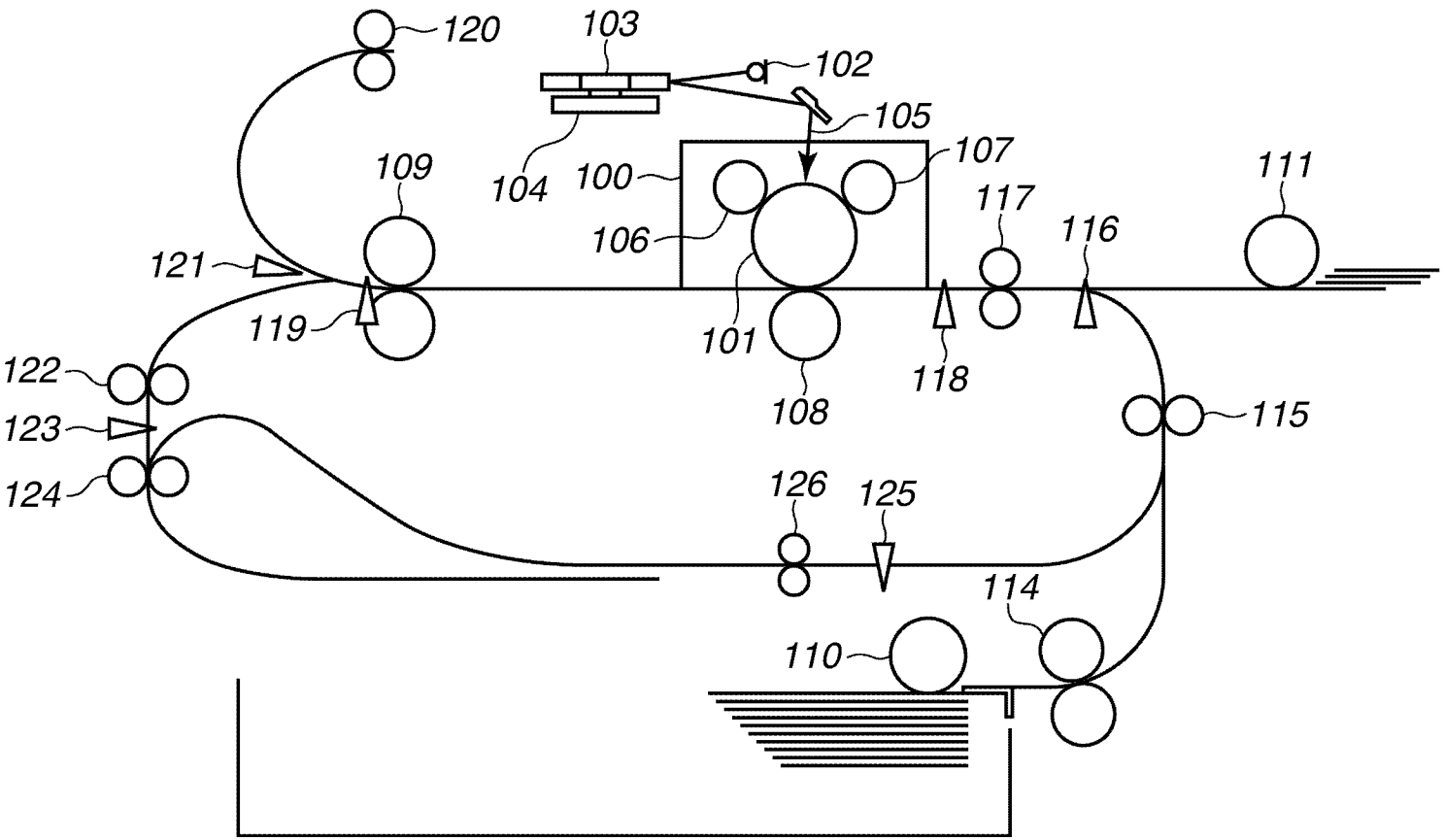
FIG. 14 is a configuration schematic diagram of an image recording apparatus main body.
Figure 15:
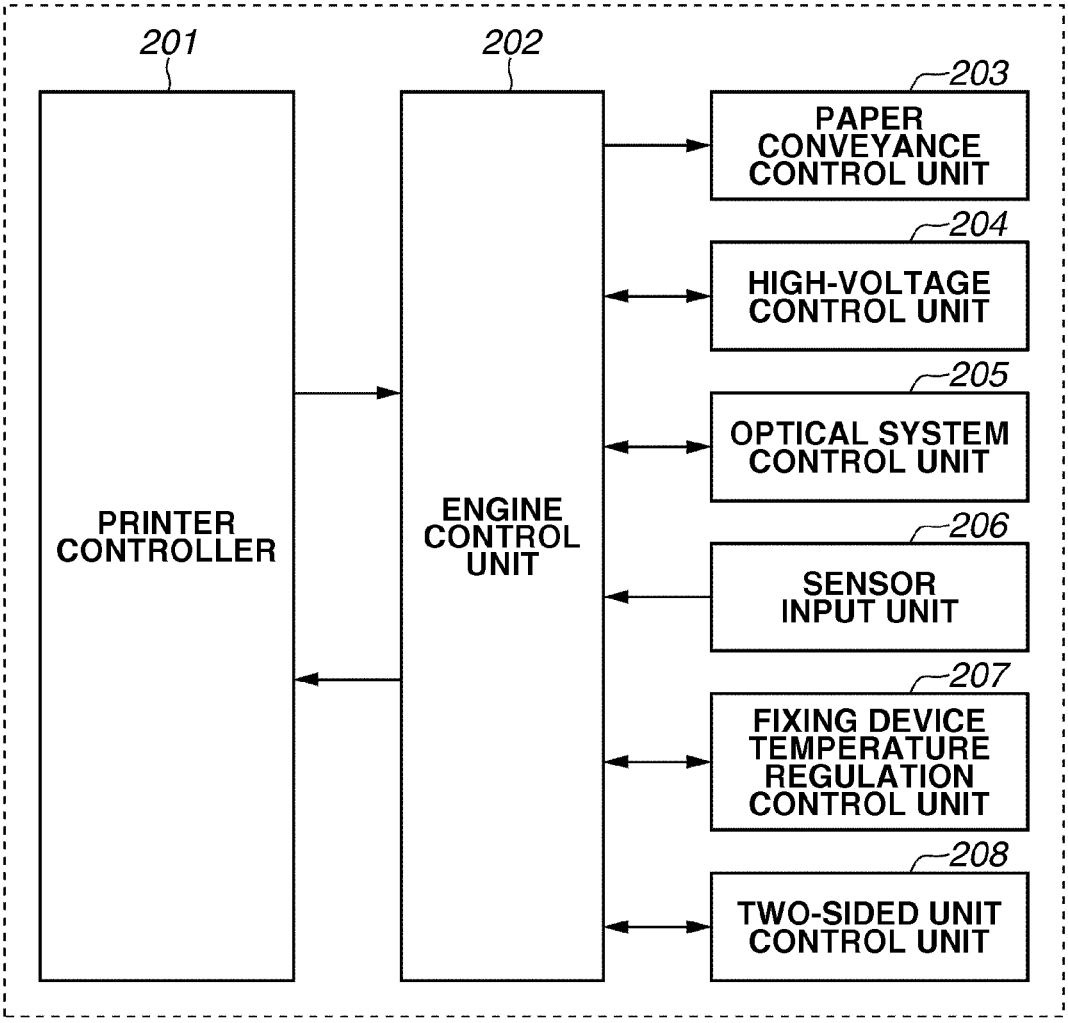
FIG. 15 is a schematic block diagram of a control unit in an image recording apparatus.

The operations performed in the flowchart of FIG. 11 are controlled by the engine control unit 202 (refer to FIG. 14). Further, since steps S300 to S325 in the flowchart of FIG. 11 are the same as the control performed in FIG. 8 according to the first exemplary embodiment, a description of those steps will be omitted here. The controls performed in steps S426 to 431 regarding setting of the development voltage according to the present exemplary embodiment will now be described.

In step S426, the engine control unit 202 determines whether the calculated discharge start voltage (step S325) is greater than the desired current value I+tolerance ("GREATER THAN" in step S426) or whether the discharged discharge start voltage is less than the desired current value I−tolerance ("LESS THAN" in step S426).

Based on that detection value, the discharge current value is calculated based on the same method as in the first exemplary embodiment. That calculated value and the desired current value I are then compared to determine whether the current value is within a tolerance for the I value. If the calculated discharge current value is greater than the desired current value I+tolerance ("GREATER THAN" in step S426), it is determined that the discharge start voltage is a low setting, so that the processing proceeds to step S427. In step S427, the transfer voltage is increased by taking the PWM signal value (transfer voltage applied to the transfer roller) up a step.

However, if the calculated discharge current value is less than the desired current value I−tolerance ("LESS THAN" in step S426), it is determined that the discharge start voltage is a high setting, so that the processing proceeds to step S428. In step S428, the transfer voltage is decreased by taking the PWM signal value (transfer voltage) down a step.

If the current value I is within the tolerance for the desired current value I based on the above-described control ("WITH IN TOLERANCE"), then in step S429, the value (transfer voltage) of the PWM signal at that point is set as the discharge start voltage V3 for the potential VL after laser beam irradiation.

In step S430, the potential VL after laser beam irradiation is calculated by determining the difference between the potential difference ΔV necessary for photosensitive drum 201 discharge to start obtained above and the discharge start voltage V3 for the potential VL after laser beam irradiation. The calculated value is VL=|V3−ΔV|, which is an absolute value.

In step S431, based on the calculated VL value, the value of the development voltage applied to the development roller is set. By controlling in this manner, the VL−Vdc voltage is controlled to a predetermined value. In step S432, after these settings have been completed, the image forming operation is started.

Next, the voltage application to the charging roller, the voltage application to the transfer roller, the timing of laser beam irradiation from the light source, and the state of the corresponding photosensitive drum potential at each step of the control described in FIG. 11 will be described with reference to FIG. 12 and FIGS. 13A, 13B, 13C, and 13D.

Figure 12:
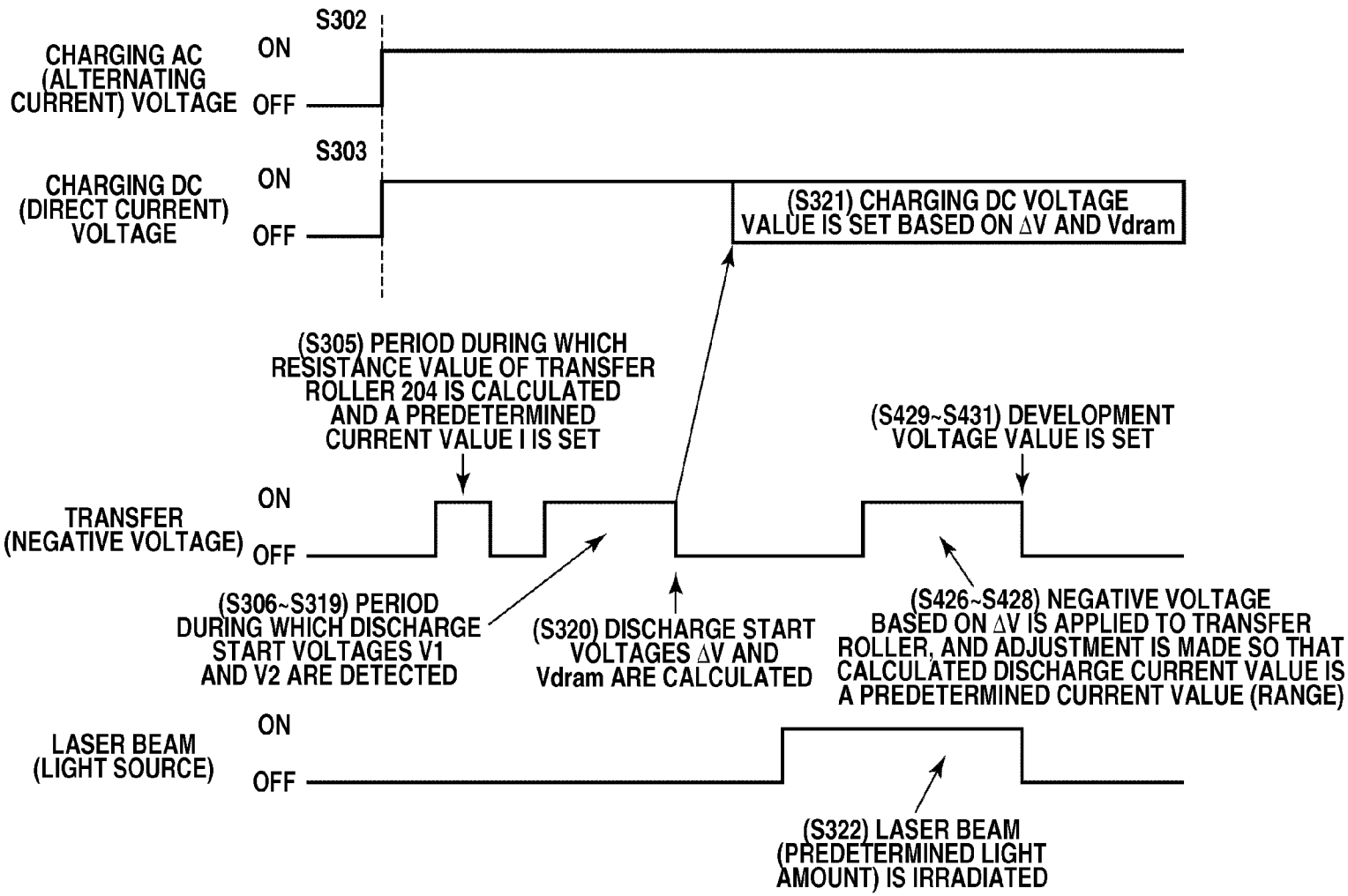
FIG. 12 is a timing chart according to the second exemplary embodiment.

In FIG. 12, since the on/off state corresponding to steps S302, S305, S306 to 320, and S322 of FIG. 9 is the same, a description thereof will be omitted here. In the present exemplary embodiment, the application of the transfer voltage to the transfer roller and the voltage correction in steps S426 to S428, and calculation of the exposure potential VL and the setting (adjustment) of the development voltage in steps S429 to 431 are different.

Figure 13A:
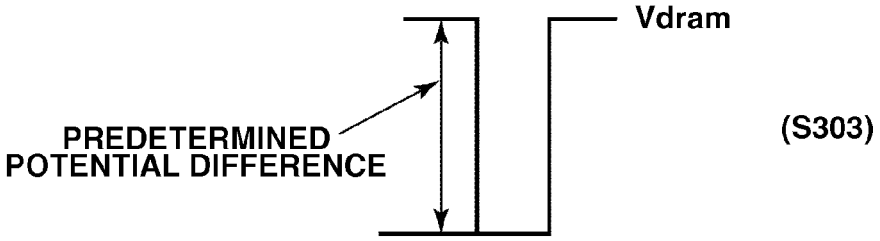
FIGS. 13A, 13B, 13C, and 13D illustrate changes in the potential of a photosensitive drum according to the second exemplary embodiment.
Figure 13B:
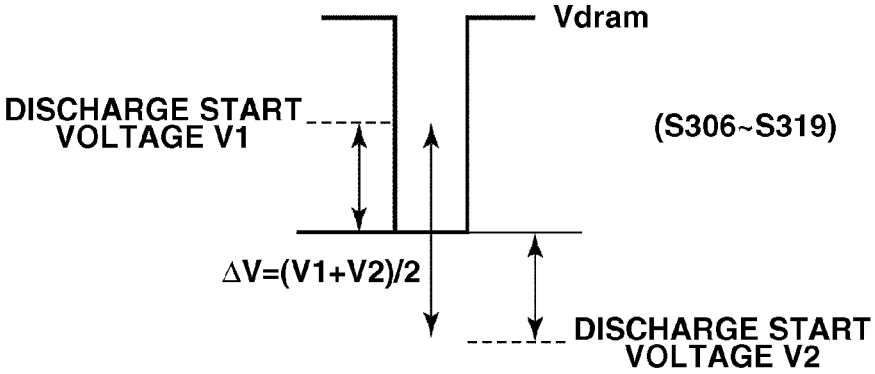
Figure 13C:
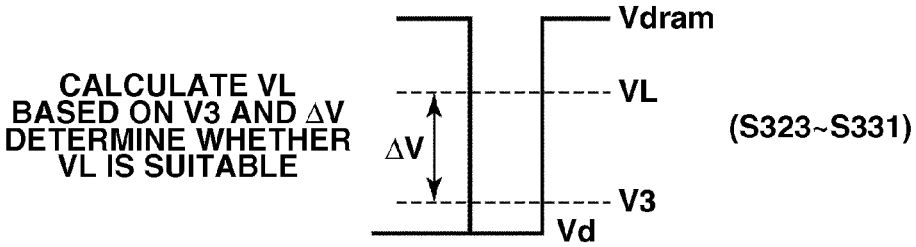
Figure 13D:
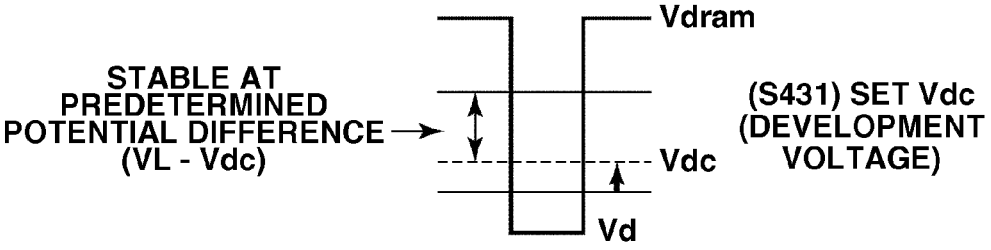

A description of the states in FIG. 13A to 13D that are the same as in FIG. 10A, 10B, and 10C (FIG. 10A: timing corresponding to step S302, FIG. 10B: timing corresponding to steps S306 to S319, and FIG. 10C: timing corresponding to steps S323 to S331) will be omitted here. In the present exemplary embodiment, the timing of step S431, which is illustrated in FIG. 13D, is different from the first exemplary embodiment. In this step, potential difference of the VL (exposure potential)−Vdc (development potential) is stabilized at the desired potential difference by setting the laser beam light amount to a constant level and correcting the value of the development voltage.

Thus, according to the present exemplary embodiment, a high-quality image with less density unevenness can be formed based on a simple configuration by appropriately controlling the potential of a photosensitive drum, regardless of changes in environment or differences in the film thickness of the photosensitive drum.

Although the configuration has been described above that transfers an image on a photosensitive drum acting as an image bearing member onto a recording material, the present invention is not limited to this. For example, the configurations described in the first and second exemplary embodiments may also be applied in an apparatus that transfers an image on a photosensitive drum onto a transfer member (intermediate transfer belt, intermediate transfer drum etc.) other than a recording material.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-272760 filed Dec. 13, 2011, which is hereby incorporated by reference herein in its entirety.

What is claimed is:

1. An image forming apparatus comprising:

an image bearing member on which an image is formed;

a charging unit configured to charge the image bearing member;

a transfer unit configured to transfer the image formed on the image bearing member onto a transfer member;

a first voltage application unit configured to apply a predetermined voltage to the charging unit so that the image bearing member becomes charged to a predetermined potential;

a second voltage application unit configured to apply a voltage to the transfer unit; and a current detection unit configured to detect a current flowing to the image bearing member via the transfer unit when a voltage is applied to the transfer unit, wherein a surface potential of the image bearing member is determined based on information on a difference between a first voltage and a second voltage, the first voltage being applied from the second voltage application unit to the transfer unit when a value detected by the current detection unit, after the second voltage application unit applies a voltage to the transfer unit while changing the voltage from the predetermined voltage to a lower potential side, reaches a value indicating a start of discharge between the image bearing member and the transfer unit, and the second voltage being applied from the second voltage application unit to the transfer unit when a value detected by the current detection unit, after the second voltage application unit applies a voltage to the transfer unit while changing the voltage from the predetermined voltage to a higher potential side, reaches a value indicating the start of discharge between the image bearing member and the transfer unit.

2. The image forming apparatus according to claim 1, further comprising a control unit configured to obtain a difference between the first voltage and the second voltage, to determine half of the difference as a voltage difference, and to determine the surface potential of the image bearing member based on the voltage difference.

3. The image forming apparatus according to claim 1, wherein the value indicating the start of discharge between the image bearing member and the transfer unit is determined.

4. The image forming apparatus according to claim 1, wherein the first voltage application unit includes a direct current (DC) voltage application unit configured to apply a DC voltage and an alternating current (AC) voltage application unit configured to apply an AC voltage to the charging unit.

5. The image forming apparatus according to claim 2, further comprising an exposure unit configured to expose the image bearing member to form a latent image on the image bearing member, wherein operation of the exposure unit is controlled so that when a voltage based on the difference is applied to the transfer unit, a current value detected by the current detection unit is a discharge current value.

6. The image forming apparatus according to claim 2, further comprising a development unit configured to develop an image on the image bearing member, wherein when a voltage based on the difference is applied to the transfer unit, the voltage applied to the transfer unit is determined so that a current value detected by the current detection unit is a discharge current value, and the voltage applied to the development unit is set using the difference with the determined voltage.

7. The image forming apparatus according to claim 1, wherein the second voltage applied to the transfer unit by the voltage application unit is a direct current (DC) voltage.

8. A method for detecting a surface potential of an image bearing member on which an image is formed, the method comprising:

applying a predetermined voltage to a charging unit configured to charge the image bearing member;

detecting a first voltage being applied from a voltage application unit to a process member when a value detected by a current detection unit, after applying a voltage to a transfer unit while changing the voltage from a predetermined voltage to a lower potential side, reaches a value indicating a start of discharge between the image bearing member and the transfer unit;

detecting a second voltage being applied from the voltage application unit to the transfer unit when a value detected by the current detection unit, after applying the voltage to the transfer unit while changing the voltage from the predetermined voltage to a higher potential side, reaches a value indicating the start of discharge between the image bearing member and the transfer unit; and determining a surface potential of the image bearing member based on information on a difference between the first voltage and the second voltage.

9. The surface potential detection method according to claim 8, further comprising controlling to obtain a difference between the first voltage and the second voltage, to determine half of the difference as a voltage difference, and to determine the surface potential of the image bearing member based on the voltage difference.

10. The surface potential detection method according to claim 8, further comprising determining the value indicating the start of discharge between the image bearing member and the transfer unit.

11. The surface potential detection method according to claim 9, further comprising controlling operation of an exposure unit for forming a latent image on the image bearing member so that when a voltage based on the voltage difference is applied to the transfer unit, a current value detected by the current detection unit is a discharge current value.

12. The surface potential detection method according to claim 9, further comprising, when a voltage based on the voltage difference is applied to the transfer unit, determining the voltage applied to the transfer unit so that a detected current value is a discharge current value, and setting the voltage applied to a development unit for developing an image on the image bearing member using the voltage difference with the determined voltage.

13. A voltage output device configured to output a voltage to a transfer unit which acts on an image bearing member comprising:

a voltage application unit configured to apply the voltage to the transfer unit;

a current detection unit configured to detect a value corresponding to a current flowing to the transfer unit when the voltage is applied to the transfer unit, wherein, a surface potential of the image bearing member is determined based on information on a difference between a first voltage and a second voltage, the first voltage being applied from the voltage application unit to the transfer unit when a value detected by the current detection unit, after the voltage application unit applies a voltage to the transfer unit while changing the voltage from a predetermined voltage to a lower potential side, reaches a value indicating a start of discharge between the image bearing member and the transfer unit, and the second voltage being applied from the voltage application unit to the transfer unit when a value detected by the current detection unit, after the voltage application unit applies the voltage to the transfer unit while changing the voltage from a predetermined voltage to a higher potential side, reaches a value indicating the start of discharge between the image bearing member and the transfer unit.

14. The voltage output device according to claim 13, further comprising a control unit configured to obtain a difference between the first voltage and the second voltage, to determine half of the difference as a voltage difference, and to determine the surface potential of the image bearing member based on voltage difference.

* * * * *